US010234777B2

(12) United States Patent
Ohtsu et al.

(10) Patent No.: US 10,234,777 B2
(45) Date of Patent: Mar. 19, 2019

(54) TONER AND METHOD FOR MANUFACTURING TONER

(71) Applicant: CANON KABUSHIKI KAISHA, Tokyo (JP)

(72) Inventors: Takeshi Ohtsu, Toride (JP); Kentaro Kamae, Kashiwa (JP); Ryuichiro Matsuo, Moriya (JP); Yosuke Iwasaki, Abiko (JP); Wakiko Katsumata, Kashiwa (JP); Kenta Mitsuiki, Toride (JP); Masaharu Miura, Toride (JP); Koh Ishigami, Abiko (JP); Yuichi Mizo, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/457,124

(22) Filed: Mar. 13, 2017

(65) Prior Publication Data

US 2017/0269493 A1 Sep. 21, 2017

(30) Foreign Application Priority Data

Mar. 16, 2016 (JP) ..... 2016-052608

(51) Int. Cl.

| | |
|---|---|
| ***G03G 9/087*** | (2006.01) |
| ***G03G 9/08*** | (2006.01) |
| ***G03G 9/107*** | (2006.01) |
| ***G03G 9/113*** | (2006.01) |
| ***G03G 9/09*** | (2006.01) |

(52) U.S. Cl.

CPC ..... *G03G 9/08755* (2013.01); *G03G 9/0812* (2013.01); *G03G 9/0827* (2013.01); *G03G 9/08711* (2013.01); *G03G 9/08782* (2013.01); *G03G 9/0904* (2013.01); *G03G 9/1075* (2013.01); *G03G 9/1131* (2013.01); *G03G 9/1133* (2013.01)

(58) Field of Classification Search

CPC ..... G03G 9/08755; G03G 9/08786

See application file for complete search history.

(56) References Cited

U.S. PATENT DOCUMENTS 7,279,262 B2 10/2007 Fujikawa et al.
7,288,348 B2 10/2007 Hayami et al.
(Continued)

FOREIGN PATENT DOCUMENTS

JP 2009-063992 * 3/2009 ..... G03G 9/087
JP 2011-123352 6/2011
(Continued)

OTHER PUBLICATIONS

Translation of JP 2009-063992 published Mar. 2009.*
U.S. Appl. No. 15/431,821, filed Feb. 14, 2017.

*Primary Examiner* — Peter L Vajda
(74) *Attorney, Agent, or Firm* — Venable LLP

(57) ABSTRACT

A toner is provided, which is obtained by heat treating a toner particle containing a crystalline polyester resin, an amorphous polyester resin, a hydrocarbon wax and a wax dispersant, wherein the crystalline polyester resin is a hybrid resin having crystalline polyester segments and amorphous vinyl segments, and a mass ratio of crystalline polyester segments and amorphous vinyl segments in the crystalline polyester resin (crystalline segments/amorphous segments) is 70/30 to 98/2.

20 Claims, 2 Drawing Sheets

(56) References Cited

U.S. PATENT DOCUMENTS

| | | | |
|---|---|---|---|
| 7,396,626 | B2 | 7/2008 | Fujikawa et al. |
| 7,396,629 | B2 | 7/2008 | Baba et al. |
| 7,611,813 | B2 | 11/2009 | Ida et al. |
| 7,858,283 | B2 | 12/2010 | Ishigami et al. |
| 7,927,775 | B2 | 4/2011 | Komatsu et al. |
| 7,939,233 | B2 | 5/2011 | Inoue et al. |
| 8,084,174 | B2 | 12/2011 | Hasegawa et al. |
| 8,114,562 | B2 | 2/2012 | Ishigami et al. |
| 8,137,886 | B2 | 3/2012 | Baba et al. |
| 8,288,069 | B2 | 10/2012 | Fujikawa et al. |
| 8,298,742 | B2 | 10/2012 | Okamoto et al. |
| 8,323,726 | B2 | 12/2012 | Naka et al. |
| 8,921,023 | B2 | 12/2014 | Baba et al. |
| 8,927,188 | B2 | 1/2015 | Naka et al. |
| 8,945,805 | B2 | 2/2015 | Baba et al. |
| 8,974,994 | B2 | 3/2015 | Kamae et al. |
| 8,986,914 | B2 | 3/2015 | Fujikawa et al. |
| 9,034,551 | B2 | 5/2015 | Endo et al. |
| 9,046,800 | B2 | 6/2015 | Hotta et al. |
| 9,058,924 | B2 | 6/2015 | Komatsu et al. |
| 9,063,443 | B2 | 6/2015 | Ishigami et al. |
| 9,075,328 | B2 | 7/2015 | Minagawa et al. |
| 9,152,088 | B1 | 10/2015 | Kobori et al. |
| 9,372,420 | B2 | 6/2016 | Mizo et al. |
| 9,417,540 | B2 | 8/2016 | Hashimoto et al. |
| 9,436,112 | B2 | 9/2016 | Iwasaki et al. |
| 2010/0028796 | A1 | 2/2010 | Nakamura et al. |
| 2010/0183971 | A1 | 7/2010 | Fujikawa et al. |
| 2012/0214097 | A1 | 8/2012 | Naka et al. |
| 2012/0264043 | A1* | 10/2012 | Watanabe ..... G03G 9/0806 430/108.8 |
| 2013/0244159 | A1 | 9/2013 | Ishigami et al. |
| 2013/0309603 | A1 | 11/2013 | Takahashi et al. |
| 2014/0096409 | A1 | 4/2014 | Ohtsu et al. |
| 2014/0101966 | A1 | 4/2014 | Minagawa et al. |
| 2014/0113228 | A1 | 4/2014 | Shiotari et al. |
| 2014/0134535 | A1 | 5/2014 | Baba et al. |
| 2014/0137428 | A1 | 5/2014 | Takenaka et al. |
| 2014/0329176 | A1 | 11/2014 | Kanno et al. |
| 2015/0177634 | A1 | 6/2015 | Kamae et al. |
| 2016/0109820 | A1 | 4/2016 | Hashimoto et al. |
| 2016/0259259 | A1* | 9/2016 | Ueda ..... G03G 9/08786 |
| 2016/0334725 | A1 | 11/2016 | Katsumata et al. |
| 2017/0058067 | A1 | 3/2017 | Ohtsu et al. |

FOREIGN PATENT DOCUMENTS

| | | |
|---|---|---|
| JP | 2013-015830 | 1/2013 |
| JP | 2015-082070 | 4/2015 |

* cited by examiner

TONER AND METHOD FOR MANUFACTURING TONER

BACKGROUND OF THE INVENTION

Field of the Invention

The present invention relates to a toner for use in electrophotographic systems, electrostatic recording systems, electrostatic printing systems and toner jet systems.

Description of the Related Art

In recent years, as electrophotographic full color copiers have come into wider use, higher image quality and energy efficiency are being demanded.

To achieve higher image quality, it is necessary to improve both the transfer efficiency of the toner image from the electrostatic latent image carrier to the intermediate transfer body and the transfer efficiency of the toner image from the intermediate transfer body to the paper.

One means that has been proposed for improving transfer efficiency is to increase the circularity of the toner by heat treatment (Japanese Patent Application Publication No. 2013-15830).

SUMMARY OF THE INVENTION

However, although heat treatment increases the circularity of the toner, it also causes highly adhesive wax to be leached near the surface of the toner. The improvement effect on transfer efficiency is reduced as a result, and in some cases when sufficient transfer pressure is not applied to papers such as embossed paper and rough paper having a low degree of surface smoothness, part of the toner image is not transferred from the intermediate transfer body, resulting in image defects called white spots.

From the standpoint of energy efficiency, moreover, there has long been demand for toners that melt rapidly at low temperatures, and can therefore be fixed rapidly with low energy expenditure. To fulfill these demands the toner needs to be made softer, but from the standpoint of heat-resistant storability and durability, low-temperature fixability cannot be achieved simply by making the toner softer.

Therefore, a toner has been proposed wherein low-temperature fixability and storage stability are improved by the addition of a composite resin comprising an amorphous resin and a crystalline resin having a sharp melt property (Japanese Patent Application Publication No. 2011-123352).

With such a toner, however, because the temperature inside the copier apparatus rises during long-term image output in high-temperature, high-humidity environments, wax is leached near the surface of the toner, detracting from transfer efficiency in some cases. Moreover, because crystalline polyesters and waxes easily become charge leakage sites, the toner cannot maintain its charge amount during long-term image output in high-temperature, high-humidity environments. Fogging and other image defects may occur as a result. One means countermeasure that has been proposed is to include in the toner both a crystalline polyester and an amorphous polyester obtained by reacting an alcohol component containing an aromatic diol with a carboxylic acid component containing an aliphatic carboxylic acid compound with a specific softening point and carbon number (Japanese Patent Application Publication No. 2015-82070).

With such toners, however, when a crystalline polyester and wax are combined and the toner is heat treated, it is necessary to control not only the compatibility of the crystalline polyester, but also the dispersibility of the wax and its leaching onto the toner surface.

For these reasons, there is still room for research into ways of maintaining good transferability and charging performance during long-term image output while providing low-temperature fixability.

It is an object of the present invention to solve such problems. That is, the object is to provide a toner that maintains good transferability and charging performance even during long-term image output in high-temperature, high-humidity environments while also providing low-temperature fixability and durability.

The inventors arrived at the present invention after discovering as a result of earnest research aimed at solving these problems that it was important not only to control the composition of a crystalline polyester resin having a sharp melt property, but also to combine this crystalline polyester resin with a hydrocarbon wax and a wax dispersant.

That is, the present invention is a toner obtained by heat treating a toner particle containing a crystalline polyester resin, an amorphous polyester resin, a hydrocarbon wax and a wax dispersant, wherein the crystalline polyester resin is a hybrid resin having crystalline polyester segments and amorphous vinyl segments, and a mass ratio of the crystalline polyester segments and the amorphous vinyl segments in the crystalline polyester resin (crystalline segments/amorphous segments) is 70/30 to 98/2.

The present invention also relates to a method for manufacturing a toner including a toner particle containing a crystalline polyester resin, an amorphous polyester resin, a hydrocarbon wax and a wax dispersant, the method comprising a step of heat treating the toner particle, wherein the crystalline polyester resin is a hybrid resin having crystalline polyester segments and amorphous vinyl segments, and a mass ratio of the crystalline polyester segments and the amorphous vinyl segments in the crystalline polyester resin (crystalline segments/amorphous segments) is 70/30 to 98/2.

With the present invention, it is possible to provide a toner capable of satisfying demands for low-temperature fixability and durability while maintaining good transferability and charging performance even during long-term image output in high-temperature, high-humidity environments.

Further features of the present invention will become apparent from the following description of exemplary embodiments (with reference to the attached drawings).

DESCRIPTION OF THE EMBODIMENTS

Figure 1:
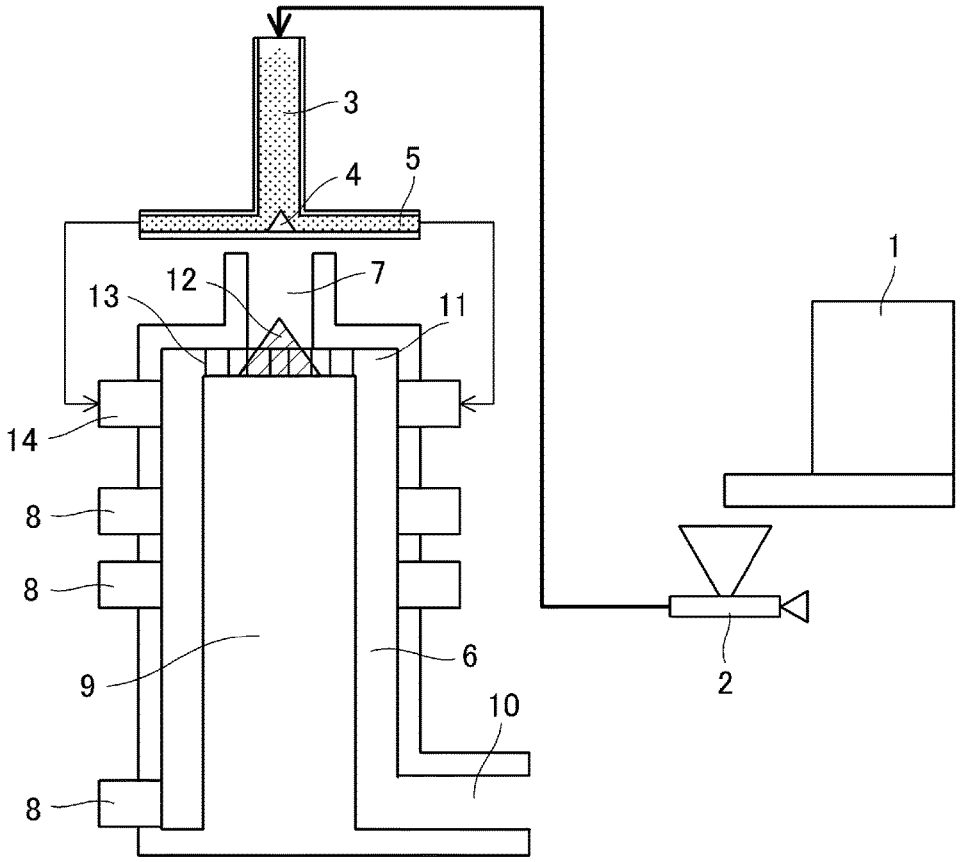
FIG. 1 is an outline of a heat spheronizing apparatus.

Unless otherwise specified, numerical ranges expressed as "at least A and not more than B" or "A to B" in the present invention include the minimum and maximum values at either end of the range.

The toner of the present invention is a toner obtained by heat treating a toner particle containing a crystalline polyester resin, an amorphous polyester resin, a hydrocarbon wax and a wax dispersant, wherein the crystalline polyester resin is a hybrid resin having crystalline polyester segments and amorphous vinyl segments, and the mass ratio of the crystalline polyester segments and the amorphous vinyl segments in the crystalline polyester resin (crystalline segments/amorphous segments) is 70/30 to 98/2.

In the present invention, the average circularity of the toner is increased and transfer efficiency is improved by heat treating a toner particle containing a crystalline polyester resin, an amorphous polyester resin, a hydrocarbon wax and a wax dispersant. Because the toner of the present invention contains a crystalline polyester resin, moreover, leaching of the wax near the toner surface in the heat-treated toner is suppressed. This is thought to be because the crystalline polyester resin has relatively low polarity and high affinity for the wax. The crystalline polyester resin is preferably an ester compound of a long-chain hydrocarbon diol and a dicarboxylic acid.

The crystalline polyester resin used in the present invention is a hybrid resin having crystalline polyester segments and amorphous vinyl segments.

Because the crystalline polyester resin is a hybrid resin, leaching of the wax near the toner surface in the heat-treated toner is further suppressed. This is thought to be because the amorphous vinyl segments of the hybrid resin further suppress leaching of the wax during heat treatment. Transfer efficiency is improved as a result. The toner surface can be observed by SEM for example to verify whether it has been heat treated.

In the present invention, a crystalline polyester resin is used in combination with a hydrocarbon wax and a wax dispersant. Leaching of the wax to the toner particle surface is suppressed by the wax dispersant. As a result, it is thought that even when the toner is left in a high-temperature, high-humidity environment, the fluidity of the toner does not decline, blocking resistance improved, and good charging performance is obtained.

Moreover, in the present invention the mass ratio of crystalline polyester segments to amorphous vinyl segments in the crystalline polyester resin (crystalline segments/amorphous segments) is 70/30 to 98/2.

Because the crystalline polyester resin has amorphous vinyl segments, compatibility is improved between the amorphous polyester resin and the amorphous vinyl segments of the crystalline polyester resin, and consequently the crystalline polyester resin can be more finely dispersed in the toner than in the past. Excellent low-temperature fixability and durability can be obtained as a result.

If the mass ratio (crystalline segments/amorphous segments) is less than 70/30, the crystalline polyester resin and amorphous polyester resin will become too compatibilized, detracting from the heat resistance of the toner. Because the degree of crystallization of the crystalline polyester resin is reduced to an excessive degree, moreover, it is no longer possible to obtain a satisfactory sharp melt property in the fixing process. If the mass ratio exceeds 98/2, on the other hand, the dispersibility of the crystalline polyester resin in the toner is reduced because the compatibility between the crystalline polyester resin and the amorphous polyester resin is too low. The low-temperature fixability of the toner is reduced as a result.

The mass ratio (crystalline segments/amorphous segments) is preferably 80/20 to 90/10.

Preferred embodiments of the toner in the present invention are explained below.

(Amorphous Polyester Resin (Binder Resin))

The amorphous polyester resin used in the toner of the present invention must have a polyester resin as a principal component. In the present invention, "principal component" means a component with a content of at least 50 mass %.

As monomers for the polyester units of the polyester resin, a polyhydric alcohol (dihydric or trihydric or higher alcohol) and a polyvalent carboxylic acid (bivalent or trivalent or higher carboxylic acid) or acid anhydride or lower alkyl ester thereof are used.

Because partial crosslinking within the amorphous polyester resin molecule is effective for preparing a branched polymer, a trivalent or higher polyfunctional compound is preferred for this purpose. Therefore, the raw material monomers of the polyester units preferably include a trivalent or higher carboxylic acid or acid anhydride or low alkyl ester thereof, and/or a trihydric or higher alcohol.

The following polyhydric alcohol monomers may be used as polyhydric alcohol monomers in the polyester units of the polyester resin.

Examples of dihydric alcohol components include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, or the bisphenol represented by Formula (A) and derivatives thereof:

(A)

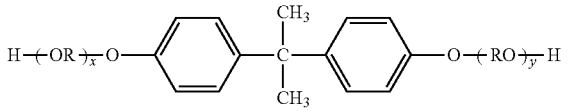

(in the formula, R is an ethylene or propylene group, x and y are each 0 or integers greater than 0, and the average value of x+y is at least 0 and not more than 10);

or the diol represented by Formula (B):

(B)

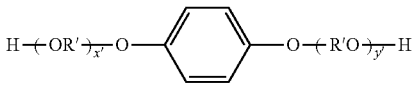

(in which R' is

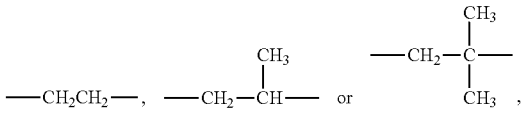

each of x' and y' is 0 or an integer greater than 0, and the average of x'+y' is 0 to 10).

Examples of trihydric or higher alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene. Of these, glycerol, trimethylolpropane or pentaerythritol is preferred. These dihydric and trihydric and higher alcohols may be used independently, or multiple alcohols may be combined.

The following polyvalent carboxylic acid monomers may be used as polyvalent carboxylic acid monomers in the polyester units of the polyester resin.

Examples of bivalent carboxylic acid components include maleic aid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic acid, and acid anhydrides and lower alkyl esters thereof. Of these, maleic acid, fumaric acid, terephthalic acid or n-dodecenylsuccinic acid is preferred.

Examples of trivalent or higher carboxylic acids and their acid anhydrides or lower alkyl esters include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Empol trimer acid, and acid anhydrides or lower alkyl esters of these.

Of these, 1,2,4-benzenetricarboxylic acid or in other words trimellitic acid or a derivative thereof is preferred because it is cheap and the reaction is easy to control. These bivalent carboxylic acids and the like and trivalent or higher carboxylic acids may be used independently, or multiple acids may be combined.

The amorphous polyester resin may also be a hybrid resin consisting primarily of a polyester resin but also containing another resin component. Examples include hybrids of polyester resins with vinyl resins. A preferred method of obtaining a reaction product (such as a hybrid resin) of a polyester resin with a vinyl resin or vinyl copolymer unit is by performing a polymerization reaction of one or both resins in the presence of a polymer comprising monomer components capable of reacting with the polyester resin and the vinyl resin or vinyl copolymer units, respectively.

Of the monomers constituting the polyester resin component, monomers capable of reacting with the vinyl copolymer include unsaturated dicarboxylic acids such as phthalic acid, maleic acid, citraconic acid and itaconic acid, and their anhydrides and the like. Out of the monomers constituting the vinyl copolymer component, monomers capable of reacting with the polyester component include those having carboxyl or hydroxyl groups, as well as acrylic and methacrylic acid esters.

When the amorphous polyester resin in the present invention has a polyester resin as a principal component, various resin compounds conventionally known as binder resins may also be used in addition to the vinyl resin described above. Examples of such resin compounds include phenolic resin, natural resin-modified phenolic resin, natural resin-modified maleic resin, acrylic resin, methacrylic resin, polyvinyl acetate resin, silicone resin, polyester resin, polyurethane, polyamide resin, furan resin, epoxy resin, xylene resin, polyvinyl butyral, terpene resin, coumarone indene resin, and petroleum-based resin and the like.

The peak molecular weight of the amorphous polyester resin is preferably at least 5,000 and not more than 13,000 from the standpoint of low-temperature fixability and hot offset resistance. The acid value of the amorphous polyester resin is preferably at least 10 mg KOH/g from the standpoint of charging stability in high-temperature, high-humidity environments.

A mixture of a low-molecular-weight amorphous polyester resin B and a high-molecular-weight amorphous polyester resin A may be also be used as the amorphous polyester resin. The content ratio (A/B) of the high-molecular-weight amorphous polyester resin A and the low-molecular-weight amorphous polyester resin B is preferably 10/90 to 60/40 by mass from the standpoint of low-temperature fixability and hot offset resistance.

The peak molecular weight of the high-molecular-weight amorphous polyester resin A is preferably at least 10,000 and not more than 20,000 from the standpoint of hot offset resistance. The acid value of the high-molecular-weight amorphous polyester resin A is preferably at least 10 mg KOH/g and not more than 30 mg KOH/g from the standpoint of charging stability in high-temperature, high-humidity environments.

The number-average molecular weight of the low-molecular-weight amorphous polyester resin B is preferably at least 1,500 and not more than 3,500 from the standpoint of low-temperature fixability. The acid value of the low-molecular-weight amorphous polyester resin B is preferably not more than 10 mg KOH/g from the standpoint of charging stability in high-temperature, high-humidity environments.

(Hydrocarbon Wax (Release Agent))

The following are examples of the hydrocarbon wax used in the toner of the present invention: hydrocarbon waxes such as low-molecular-weight polyethylene, low-molecular-weight polypropylene, alkylene copolymers, microcrystalline wax, paraffin wax and Fischer-Tropsch wax; hydrocarbon wax oxides such as polyethylene oxide wax; block copolymers of these; and waxes obtained by grafting vinyl monomers such as styrene or acrylic acid to aliphatic hydrocarbon waxes.

Of these waxes, a hydrocarbon wax such as paraffin wax or Fischer-Tropsch wax is preferred for improving low-temperature fixability and hot offset resistance. In the present invention, hot offset resistance is further improved by using a hydrocarbon wax.

In the present invention, the wax is preferably used in the amount of at least 1 mass part and not more than 20 mass parts per 100 mass parts of the amorphous polyester resin.

Moreover, the peak temperature of the maximum endothermic peak of the wax in an endothermic curve obtained during temperature increase with a differential scanning calorimeter (DSC) is preferably at least 45° C. and not more than 140° C. A maximum endothermic peak temperature of the wax within this range is desirable for achieving both storability and hot offset resistance of the toner.

(Colorant)

A colorant may also be used in the present invention. The following are examples of colorants that may be included in the toner.

Examples of black colorants include carbon black and black colorants obtained by blending yellow, magenta and cyan colorants. The colorant may be a pigment used by itself, but from the standpoint of the image quality of full-color images, a dye and a pigment are preferably combined to improve color definition.

Examples pigments for magenta toners include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, 282; C.I. Pigment Violet 19; and C.I. Vat Red 1, 2, 10, 13, 15, 23, 29 and 35.

Examples of dyes for magenta toners include C.I. Solvent Red 1, 3, 8, 23, 24, 25, 27, 30, 49, 81, 82, 83, 84, 100, 109 and 121; C.I. Disperse Red 9; C.I. Solvent Violet 8, 13, 14, 21 and 27; oil-soluble dyes such as C.I. Disperse Violet 1; C.I. Basic Red 1, 2, 9, 12, 13, 14, 15, 17, 18, 22, 23, 24, 27, 29, 32, 34, 35, 36, 37, 38, 39 and 40; and basic dyes such as C.I. Basic Violet 1, 3, 7, 10, 14, 15, 21, 25, 26, 27 and 28.

Examples of pigments for cyan toners include C.I. Pigment Blue 2, 3, 15:2, 15:3, 15:4, 16 and 17; C.I. Vat Blue 6; C.I. Acid Blue 45; and copper phthalocyanine pigments obtained by substituting 1 to 5 phthalimidomethyl groups in a phthalocyanine skeleton.

An example of a dye for a cyan toner is C.I. Solvent Blue 70.

Examples of pigments for yellow toners include C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181 and 185; and C.I. Vat Yellow 1, 3 and 20.

Examples of dyes for yellow toners include C.I. Solvent Yellow 162.

The amount of the colorant that is used is preferably at least 0.1 mass parts and not more than 30 mass parts per 100 mass parts of the amorphous polyester resin.

(Charge Control Agent)

A charge control agent may be included in the toner as necessary. A known charge control agent may be used in the toner, but a metal compound of an aromatic carboxylic acid that is colorless and provides both a rapid charging speed and a stable, uniform charging quantity of the toner is preferred.

Examples of negative charge control agents include salicylic acid metal compounds, naphthoic acid metal compounds, dicarboxylic acid metal compounds, polymeric compounds having sulfonic acids or carboxylic acids in the side chains, polymeric compounds having sulfonate salts or sulfonic acid esterification products in the side chains, polymeric compounds having carboxylate salts or carboxylic acid esterification products in the side chains, and boron compounds, urea compounds, silicon compounds, and calixarenes. Examples of positive charge control agents include quaternary ammonium salts, polymeric compounds having such quaternary ammonium salts in the side chains, guanidine compounds and imidazole compounds. The charge control agent may be added either internally or externally to the toner particle. The added amount of the charge control agent is preferably at least 0.2 mass parts and not more than 10 mass parts per 100 mass parts of the amorphous polyester resin.

(Crystalline Polyester Resin)

In the present invention, a crystalline resin is a resin for which a clear endothermic peak (melting point) is observed in a reversible specific heat change curve obtained by measuring changes in specific heat with a differential scanning calorimeter.

The crystalline polyester resin used in the present invention is a hybrid resin having crystalline polyester segments and amorphous vinyl segments, in which the mass ratio of the crystalline polyester segments and amorphous vinyl segments in the crystalline resin (crystalline segments/amorphous segments) is 70/30 to 98/2.

Moreover, the crystalline polyester resin of the present invention preferably has a weight-average molecular weight (Mw) of at least 5,000 and not more than 50,000. If the Mw is at least 5,000 and not more than 50,000, it is possible to obtain a rapid plasticization effect from the crystalline resin in the fixing step while maintaining a high degree of crystallization of the crystalline polyester resin in the toner manufacturing process. As a result, excellent heat-resistant storability and excellent fixability under low-temperature conditions and high-speed conditions can both be achieved. The weight-average molecular weight (Mw) is more preferably at least 6,000 and not more than 21,000.

The weight-average molecular weight (Mw) of the crystalline polyester resin of the present invention can be controlled by controlling the various manufacturing conditions for the crystalline polyester resin, such as for example the substance ratios of the polyvalent carboxylic acid and diol in the raw materials, or the reaction temperature, reaction time or the like. The method for measuring the weight-average molecular weight (Mw) of the crystalline resin is described below.

The weight-average molecular weight (Mw) of the amorphous vinyl segments in the crystalline polyester resin is preferably at least 5,000 and not more than 50,000. If the weight-average molecular weight (Mw) is at least 5,000 and not more than 50,000, the amorphous vinyl segments will be more uniformly dispersed in the crystalline polyester resin. Compatibility between the crystalline polyester resin and the amorphous polyester resin is thereby improved, resulting in improved low-temperature fixability. This weight-average molecular weight (Mw) is more preferably at least 6,000 and not more than 23,000.

The weight-average molecular weight (Mw) of the amorphous vinyl segments can be controlled by controlling the various polyester manufacturing conditions, such as the added amount of the bireactive monomer during crystalline resin manufacture. The method for measuring the weight-average molecular weight (Mw) of the amorphous vinyl segments is explained below.

Next, the crystalline polyester constituting the crystalline polyester segments in the crystalline polyester resin of the present invention can be obtained by reacting a bivalent or higher polyvalent carboxylic acid with a diol. A polyester composed primarily of an aliphatic diol and an aliphatic dicarboxylic acid is preferred because it has a high degree of crystallinity. One kind of crystalline polyester may be used, or multiple kinds may be used together.

The crystalline polyester segments are preferably obtained by a polycondensation reaction of a monomer composition containing a $C_{2-22}$ aliphatic diol and a $C_{2-22}$ aliphatic dicarboxylic acid as primary components. Of these, the earnest researches of the inventors in this case have shown that a polycondensate of a $C_{6-12}$ (more preferably $C_{6-10}$) aliphatic diol and a $C_{6-12}$ (more preferably $C_{8-12}$) aliphatic dicarboxylic acid is desirable from the standpoint of low-temperature fixability and storability.

The reason why the low-temperature fixability of the toner is improved by using a crystalline polyester is that the amorphous polyester resin and crystalline polyester compatibilize, expanding the gaps in the molecular chains of the amorphous polyester resin and weakening the intermolecular force so that the glass-transition temperature (Tg) is greatly reduced, resulting in a lower melt viscosity. Thus, low-temperature fixability tends to improve when the compatibility between the amorphous polyester resin and the crystalline polyester resin is increased.

The compatibility between the amorphous polyester resin and the crystalline polyester resin can be increased by reducing the carbon numbers of the aliphatic diol and/or aliphatic dicarboxylic acid in the monomers constituting the crystalline polyester, increasing the ester group concentration, and increasing the polarity. Even in a toner with a greatly reduced glass transition temperature (Tg), storability must be ensured during use and transport and the like in high-temperature, high-humidity environments. Therefore, when the toner has been exposed to such an environment, it is desirable to recrystallize the compatibilized crystalline polyester in the toner and return the Tg of the toner to the Tg of the amorphous polyester resin.

If the ester group concentration of the crystalline polyester is not too high and the compatibility between the binder resin and the crystalline polyester is not too great, the crystalline polyester will be easy to recrystallize, resulting in good toner storability. For these reasons, the inventors found that it is desirable to use a $C_{6-12}$ aliphatic diol and a $C_{6-12}$ aliphatic dicarboxylic acid as constituent monomers of a crystalline polyester resin capable of providing both low-temperature fixability and storability.

The $C_{2-22}$ (more preferably $C_{6-12}$) aliphatic diol is not particularly limited, but a chain (more preferably linear chain) aliphatic diol is preferred, and examples include ethylene glycol, diethylene glycol, triethylene glycol, 1,2-propanediol, 1,3-propanediol, dipropylene glycol, 1,4-butanediol, 1,4-butadiene glycol, trimethylene glycol, tetramethylene glycol, pentamethylene glycol, hexamethylene glycol, octamethylene glycol, nonamethylene glycol, decamethylene glycol and neopentyl glycol. Of these, a linear chain aliphatic diol such as ethylene glycol, diethylene glycol, 1,4-butanediol or 1,6-hexanediol, or a $\alpha,\omega$-diol is preferred.

An alcohol selected from the $C_{2-22}$ aliphatic diols preferably constitutes at least 50 mass % and not more than 100 mass %, or more preferably at least 70 mass % and not more than 100 mass % of the alcohol components.

A polyhydric alcohol monomer other than the aforementioned aliphatic diol may also be used in the present invention. Of the polyhydric alcohol monomers, examples of dihydric alcohol monomers include aromatic alcohols such as polyoxyethylenated bisphenol A and polyoxypropylenated bisphenol A; and 1,4-cyclohexanedimethanol and the like. Examples of trihydric and higher polyhydric alcohol monomers include aromatic alcohols such as 1,3,5-trihydroxymethylbenzene; and aliphatic alcohols such as pentaerythritol, dipentaerythritol, tripentaerythritol, 1,2,4-butanetriol, 1,2,5-pentanetriol, glycerin, 2-methylpropanetriol, 2-methyl-1,2,4-butanetriol, trimethylol ethane, trimethylol propane and the like.

A monohydric alcohol may also be used in the present invention as long as this does not detract from the properties of the crystalline polyester. Examples of this monohydric alcohol include n-butanol, isobutanol, sec-butanol, n-hexanol, n-octanol, 2-ethylhexanol, cyclohexanol and benzyl alcohol.

The $C_{2-22}$ (more preferably $C_{6-12}$) aliphatic dicarboxylic acid is also not particularly limited, but a chain (preferably linear chain) aliphatic dicarboxylic acid is preferred. Specific examples include oxalic acid, malonic acid, succinic acid, glutaric acid, adipic acid, pimelic acid, suberic acid, glutaconic acid, azelaic acid, sebacic acid, nonanedicarboxylic acid, decanedicarboxylic acid, undecanedicarboxylic acid, dodecanedicarboxylic acid, maleic acid, fumaric acid, mesaconic acid, citraconic acid and itaconic acid, as well as those obtained by hydrolyzing acid anhydrides or lower alkyl esters of these.

In the present invention, a carboxylic acid selected from the $C_{2-22}$ aliphatic dicarboxylic acids preferably constitutes at least 50 mass % and not more than 100 mass %, or more preferably at least 70 mass % and not more than 100 mass % of the carboxylic acid component.

A polyvalent carboxylic acid other than the aforementioned $C_{2-22}$ aliphatic dicarboxylic acid may also be used in the present invention. Of the other polyvalent carboxylic acid monomers, examples of bivalent carboxylic acids include aromatic carboxylic acids such as isophthalic acid and terephthalic acid; aliphatic carboxylic acids such as n-dodecylsuccinic acid and n-dodecenylsuccinic acid; and alicyclic carboxylic acids such as cyclohexanedicarboxylic acid, and acid anhydrides and lower alkyl esters of these and the like. Of the other carboxylic acid monomers, examples of trivalent and higher polyvalent carboxylic acids include aromatic carboxylic acids such as 1,2,4-benzenetricarboxylic acid (trimellitic acid), 2,5,7-naphthalenetricarboxylic acid, 1,2,4-naphthalenetricarboxylic acid and pyromellitic acid, and aliphatic carboxylic acids such as 1,2,4-butanetricarboxylic acid, 1,2,5-hexanetricarboxylic acid and 1,3-dicarboxyl-2-methyl-2-methylenecarboxypropane, and derivatives of these such as acid anhydrides and lower alkyl esters.

A monovalent carboxylic acid may also be included in the present invention as long as this does not detract from the properties of the crystalline polyester. Examples of monovalent carboxylic acids include naphthalenecarboxylic acid, salicylic acid, 4-methylbenzoic acid, 3-methylbenzoic acid, phenoxyacetic acid, biphenylcarboxylic acid, acetic acid, propionic acid, butyric acid and octanoic acid.

The content of the crystalline polyester resin in the toner particle of the present invention is preferably at least 1.0 mass parts and not more than 15.0 mass parts, or more preferably at least 3.0 mass parts and not more than 8.0 mass parts per 100.0 mass parts of the amorphous polyester resin. If the content of the crystalline polyester resin is within this range, low-temperature fixability is improved because the crystalline polyester is easy to finely disperse in the toner.

The content of the crystalline polyester resin in the toner particle of the present invention is preferably equal to or greater than the content of the hydrocarbon wax. More preferably, the content of the crystalline polyester resin is greater than the content of the hydrocarbon wax.

If the content of the crystalline polyester resin is equal to or greater than the content of the hydrocarbon wax, the amorphous vinyl segments can effectively suppress leaching of the wax during heat treatment, and transfer efficiency is improved.

One method of manufacturing the hybrid resin in the present invention is to promote a polymerization reaction in a pressurized environment when preparing the amorphous vinyl segments. Specifically, this may be an ester exchange reaction between the hydroxyl groups contained in the crystalline polyester segments and the (meth)acrylic ester contained in the amorphous vinyl segments, an esterification reaction between the hydroxyl groups contained in the crystalline polyester segments and the carboxyl groups contained in the amorphous vinyl segments, or an esterification reaction between the carboxyl groups contained in the crystalline polyester segments and the hydroxyl groups contained in the amorphous vinyl segments, or else radicals may be generated in the crystalline polyester segments by a hydrogen abstraction reaction, after which the vinyl monomer is added and polymerized in a pressurized environment. The degree of pressurization in this case is preferably at least 0.20 MPa and not more than 0.45 MPa.

A monofunctional polymerizable monomer or polyfunctional polymerizable monomer may be used as the vinyl polymerizable monomer for manufacturing the amorphous vinyl segments in the hybrid resin. Examples of the monofunctional polymerizable monomer include styrene; styrene derivatives such as $\alpha$-methylstyrene, o-methylstyrene, m-methylstyrene and p-methylstyrene; acrylic polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octylacrylate, n-nonyl acrylate and cyclohexyl acrylate; and methacrylic polymerizable monomers having methacrylate in place of acrylate in the acrylic polymerizable monomers listed above.

Examples of the polyfunctional polymerizable monomer include acrylic polyfunctional polymerizable monomers such as diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxy-diethoxy)phenyl)propane, trimethylolpropane triacrylate and tetramethylolmethane tetraacrylate; methacrylic polyfunctional polymerizable monomers having methacrylate in place of acrylate in the acrylic polyfunctional polymerizable monomers listed above; and divinyl benzene, divinyl naphthalene and divinyl ether.

The vinyl monomer is preferably one having a carboxy group or hydroxy group, or one containing a (meth)acrylic acid ester. When a carboxy group (a highly polar functional group) is present in the amorphous vinyl segments of the hybrid resin, the toner particle can be stabilized during toner particle manufacture because the amorphous vinyl segments have a suitable degree of polarity.

A copolymer of a vinyl polymerizable monomer (preferably styrene) and acrylic acid is desirable for the amorphous vinyl segments of the hybrid resin because the toner surface is reinforced by hydrogen bonds formed by the carboxy group of the acrylic acid, resulting in superior durability. The content of the acrylic acid in the hybrid resin is preferably not more than 3.0 mass % in order to prevent excessive hygroscopicity in high-temperature, high-humidity environments and give the toner good triboelectric charge properties.

An oil-soluble initiator and/or a water-soluble initiator may be used appropriately as a polymerization initiator for polymerizing the vinyl polymerizable monomer when manufacturing the hybrid resin as long as this does not interfere with the effects of the present invention. Examples of oil-soluble initiators include azo compounds such as 2,2'-azobisisobutyronitrile; and peroxides such as t-butylperoxyneodecanoate, t-hexylperoxypivalate, lauroyl peroxide, t-butylperoxy-2-ethylhexanoate, t-butylperoxyisobutyrate, di-t-butylperoxyisophthalate and di-t-butylperoxide.

Examples of water-soluble initiators include ammonium persulfate, potassium persulfate, 2,2'-azobis(N,N'-dimethyleneisobutyroamidine) hydrochloride, 2,2'-azobis(2-amidinopropane) hydrochloride, azobis(isobutylamidine) hydrochloride, 2,2'-azobisisobutyronitrile sodium sulfonate, 2,2'-azobis {2-methyl-N-[1,1-bis(hydroxymethyl)-2-hydroxyethyl]propionamide}, 2,2'-azobis {2-methyl-N-[2-(1-hydroxybutyl)]-propionamide}, ferrous sulfate hydrochloride, and hydrogen peroxide.

A peroxide is especially desirable. When the crystalline polyester segments are vinyl denatured by a hydrogen abstraction reaction, suitable reactivity is obtained if the 10-hour half-life temperature is preferably at least 70° C. and not more than 170° C., or more preferably at least 75° C. and not more than 130° C.

Preferably one or more aliphatic compounds selected from the $C_{10-20}$ (more preferably $C_{18-20}$) aliphatic monocarboxylic acids and $C_{10-20}$ (more preferably $C_{18-20}$) aliphatic monoalcohols are condensed at the end of the molecular chain of the crystalline polyester resin.

By condensing an aliphatic compound at the end of the molecular chain of the crystalline polyester resin, it is possible to increase the crystallinity of the crystalline polyester resin and improve the storability of the toner.

In crystal segments in general, crystal growth can occur after a crystal nucleus has formed. When an aliphatic compound is present at the end of the crystalline polyester resin, it is possible to promote crystal growth by a segment (hereunder called segment a) capable of assuming a crystal structure, and to thereby improve the crystallization rate of the crystalline polyester resin. This allows reversible phase transitions to occur in the toner.

The compound forming the aliphatic compound part is preferably a compound with a faster crystallization rate than the segment a, without any particular limitation. From the standpoint of achieving a fast crystallization rate, however, it is preferably a compound containing a hydrocarbon segment in the main chain and one or more functional groups capable of reacting with the ends of the crystalline polyester resin. Moreover, preferably the hydrocarbon segment is linear, and the number of functional groups reacting with the crystalline polyester resin is 1.

For purposes of increasing the reactivity of the aliphatic compound with the ends of the crystalline polyester resin, the molecular weight of the aliphatic compound is preferably 100 to 10,000, or more preferably 150 to 5,000.

The aliphatic compound is not particularly limited as long as it is one that binds to the ends of the polyester resin, but preferably it is at least one selected from the group consisting of the $C_{10-20}$ aliphatic monocarboxylic acids and $C_{10-20}$ aliphatic monoalcohols.

If the aliphatic compound has at least a certain number of carbon atoms, the degree of crystallization of the aliphatic compound is increased, and molecular motion occurs more easily than in the segment a of the crystalline polyester resin, so that the crystallization rate of the aliphatic compound can be increased. For purposes of increasing the crystallization rate, the aliphatic compound is preferably contained in the amount of at least 0.1 mol parts and not more than 10.0 mol parts, or more preferably at least 0.2 mol parts and not more than 7.0 mol parts per 100 mol parts of the raw material monomers of the crystalline polyester segments.

Within this range, the compatibility between the crystalline polyester resin and amorphous polyester resin can be adjusted appropriately, and image peeling can also be controlled when the fixed image is bent or folded. In particular, good fixability (low-pressure fixability) can be obtained with image-forming apparatuses that apply a low fixing pressure.

Examples of the $C_{10-20}$ aliphatic monocarboxylic acid include capric acid (decanoic acid), undecylic acid, lauric acid (dodecanoic acid), tridecylic acid, myristic acid (tetradecanoic acid), pentadecylic acid, palmitic acid (hexadecanoic acid), margaric acid (heptadecanoic acid), stearic acid (octadecanoic acid), nonadecylic acid and arachidic acid (eicosanoic acid).

Examples of the $C_{10-20}$ aliphatic monoalcohol include capryl alcohol (decanol), undecanol, lauryl alcohol (dodecanol), tridecanol, myristyl alcohol (tetradecanol), pentadecanol, palmityl alcohol (hexadecanol), margaryl alcohol (heptadecanol), stearyl alcohol (octadecanol), nonadecanol and arachidyl alcohol (icosanol).

The following analysis can determine whether or not the aliphatic compound has bound to the crystalline polyester resin.

2 mg of sample is weighed precisely, and 2 ml of chloroform is added to dissolve the sample and prepare a sample solution. A crystalline polyester resin can be used as the resin sample, but when a crystalline polyester resin is difficult to obtain, a toner containing a crystalline polyester resin can be substituted as the sample. Next, 20 mg of 2,5-dihydroxybenzoic acid (DHBA) is weighed precisely, and dissolved by addition of 1 ml of chloroform to prepare a matrix solution. 3 mg of sodium trifluoroacetate (NaTFA) is also weighed precisely, and dissolved by adding 1 ml of acetone to prepare an ionization aid solution.

25 μl of the sample solution, 50 μl of the matrix solution and 5 μl of the ionization aid solution thus prepared are mixed and dripped onto a sample plate for MALDI analysis, and dried to obtain a measurement sample. Using a MALDI-TOFMS (Bruker Daltonics Reflex III) as the analysis equipment, a mass spectrum is obtained. Each peak in the oligomer range (m/Z not more than 2000) of the resulting mass spectrum is attributed, and the existence of a peak corresponding to the composition of the aliphatic compound bound to the molecular ends is confirmed.

The carbon number of the aliphatic compound can be measured by NMR and pyrolysis gas chromatography of the crystalline polyester isolated by the following methods. The carbon numbers of the units derived from the monomers of the crystalline polyester segments can also be measured by NMR and pyrolysis gas chromatography.

(Inorganic Fine Particle)

An inorganic fine particle may also be included in the toner of the present invention as necessary. The inorganic fine particle may be added internally to the toner particle, or mixed with the toner particle as an external additive. Inorganic fine particles such as silica, titanium oxide and aluminum oxide are preferred as external additives. The inorganic fine particle is preferably one that has been hydrophobized with a hydrophobizing agent such as a silane compound, silicone oil or a mixture of these.

An inorganic fine particle with a specific surface area of at least 50 $m^2/g$ and not more than 400 $m^2/g$ is preferred as an external additive for improving fluidity, while an inorganic fine particle with a specific surface area of at least 10 $m^2/g$ and not more than 50 $m^2/g$ is preferred for stabilizing durability. Inorganic particles with specific surface areas within the aforementioned ranges may be combined to achieve both improved fluidity and durability stabilization.

The external additive is preferably used in the amount of at least 0.1 mass parts and not more than 10.0 mass parts per 100 mass parts of the toner particle. The toner particle and external additive may be mixed with a known mixing apparatus such as a Henschel mixer.

(Wax Dispersant)

The wax dispersant of the present invention is a polymer comprising a styrene acrylic polymer graf-polymerized onto a polyolefin, and the styrene acrylic polymer preferably contains a unit derived from a saturated alicyclic compound.

In the wax dispersant, the styrene acrylic polymer segment has affinity for the amorphous polyester resin, and the polyolefin segment has affinity for the wax contained in the toner particle. It is thus possible to finely disperse the wax in the toner particle.

When the styrene acrylic polymer has a unit derived from a saturated alicyclic compound, moreover, it is possible to not only finely disperse the wax in the toner particle, but also to maintain the charging performance even when the toner is left standing in a high-temperature, high humidity environment.

Based on the researches of the inventors, the following mechanisms are thought to operate.

When a toner is left standing in a high-temperature, high-humidity environment, the wax normally migrates to the toner particle surface.

When the toner particle contains a wax dispersant such as that described above, however, it is thought that when the wax migrates to the toner particle surface, the wax dispersant also migrates to the toner particle surface together with the wax.

Because unlike conventional wax dispersants, a wax dispersant such as that described above has a structural segment derived from a bulky saturated alicyclic compound, leaching of the wax is suppressed even when the wax dispersant migrates to the toner particle surface. Therefore, it is thought that toner fluidity does not decline, blocking resistance is improved, and the charging performance is not reduced even when the toner is left standing in a high-temperature, high-humidity environment.

When the wax dispersant migrates to the toner particle surface, moreover, it is thought that because the structural segment derived from a saturated alicyclic compound is hydrophobic, the hydrophobicity of the toner particle is improved and the charging performance does not decline even when the toner is left standing in a high-temperature, high-humidity environment.

The wax dispersant contains a polymer comprising a styrene acrylic polymer graft-polymerized onto a polyolefin, and this styrene acrylic polymer has structural segments derived from a saturated alicyclic compound.

The polyolefin is not particularly limited, but from the standpoint of affinity with the wax in the toner particle, it may be selected from the hydrocarbon waxes (release agents) used in the toner of the present invention as discussed above.

In the present invention, desirable examples of the polyolefin include hydrocarbon waxes such as low-molecular-weight polyethylene, low-molecular-weight polypropylene, alkylene copolymers, microcrystalline wax, paraffin wax and Fischer-Tropsch wax. In the wax and wax dispersant, a low-molecular-weight polyolefin is one with a molecular weight of preferably 200 to 10,000.

A branched structure such as polypropylene is also preferred from the standpoint of reactivity when manufacturing the wax dispersant.

The method of graft denaturing the polyolefin with the styrene acrylic polymer is not particularly limited, and a conventional known method may be used.

In the wax dispersant, the styrene acrylic polymer preferably has a structural segment derived from a saturated alicyclic compound.

The styrene acrylic polymer may be one having a monomer unit represented by Formula (1) below:

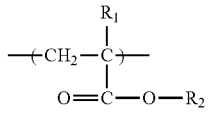

(1)

[in Formula (1), $R_1$ represents a hydrogen atom or methyl group, and $R_2$ represents a saturated alicyclic group].

The saturated alicyclic group of $R_2$ above is preferably a saturated alicyclic hydrocarbon group, or more preferably a $C_{3-18}$ saturated alicyclic hydrocarbon group, or still more preferably a $C_{4-12}$ saturated alicyclic hydrocarbon group. Saturated alicyclic hydrocarbon groups include cycloalkyl groups, condensed polycyclic hydrocarbon groups, cross-linked cyclic hydrocarbon groups and spiro hydrocarbon groups.

Examples of such saturated alicyclic groups include cyclopropyl, cyclobutyl, cyclopentyl, cyclohexyl, t-butylcyclohexyl, cycloheptyl, cyclooctyl, tricyclodecanyl, decahydro-2-naphthyl, tricyclo[5.2.1.02,6]decan-8-yl, pentacyclopentadecanyl, isobornyl, adamantyl, dicyclopentanyl and tricyclopentanyl groups and the like.

The saturated alicyclic group may also have an alkyl group, halogen atom, or carboxy, carbonyl or hydroxy group or the like as a substituent. The alkyl group is preferably a $C_{1-4}$ alkyl group.

Of these saturated alicyclic groups, a cycloalkyl group, condensed polycyclic hydrocarbon group or crosslinked cyclic hydrocarbon group is preferred, a $C_{3-18}$ cycloalkyl group, optionally substituted dicyclopentanyl group or optionally substituted tricyclopentanyl group is more preferred, a $C_{4-12}$ cycloalkyl group is still more preferred, and a $C_{6-10}$ cycloalkyl group is especially preferred.

The positions and number of the substituents are optional, and when there are two or more substituents they may be the same or different.

The styrene acrylic polymer may be a homopolymer of a vinyl monomer (a) having a structural unit derived from a saturated alicyclic compound, or may be a copolymer with another monomer (b).

Examples of the vinyl monomer (a) include such monomers as cyclopropyl acrylate, cyclobutyl acrylate, cyclopentyl acrylate, cyclohexyl acrylate, cycloheptyl acrylate, cyclooctyl acrylate, cyclopropyl methacrylate, cyclobutyl methacrylate, cyclopentyl methacrylate, cyclohexyl methacrylate, cycloheptyl methacrylate, cyclooctyl methacrylate, dihydrocyclopentadiethyl acrylate, dicyclopentanyl acrylate and dicyclopentanyl methacrylate, and combinations of these.

Of these, cyclohexyl acrylate, cycloheptyl acrylate, cyclooctyl acrylate, cyclohexyl methacrylate, cycloheptyl methacrylate or cyclooctyl methacrylate is preferred from the standpoint of hydrophobicity.

Examples of the other monomer (b) include styrene monomers such as styrene, α-methylstyrene, p-methylstyrene, m-methylstyrene, p-methoxystyrene, p-hydroxystyrene, p-acetoxystyrene, vinyl toluene, ethyl styrene, phenyl styrene and benzyl styrene; alkyl esters (with $C_{1-18}$ alkyls) of unsaturated carboxylic acids, such as methyl acrylate, ethyl acrylate, butyl acrylate, 2-ethylhexyl acrylate, methyl methacrylate, ethyl methacrylate, butyl methacrylate and 2-ethylhexyl methacrylate; vinyl ester monomers such as vinyl acetate; vinyl ether monomers such as vinyl methyl ether; vinyl monomers containing halogen elements, such as vinyl chloride; diene monomers such as butadiene and isobutylene; and combinations of these. Of these, styrene or butyl acrylate is preferred.

The styrene acrylic polymer of the wax dispersant preferably contains a unit derived from styrene. The content of the unit derived from styrene in the wax dispersant is preferably at least 20 mass % and not more than 90 mass %, or more preferably at least 40 mass % and not more than 75 mass %.

If the content of unit derived from styrene in the wax dispersant of the present invention is within this range, the hydrophobicity of the toner particle is improved, and the charging performance does not decline even when the particle is left standing in a high-temperature, high-humidity environment. This is thought to be because the styrene part of the hydrophobic wax dispersant increases the hydrophobicity of the toner particle. At 90 mass % or less, the amount of the polyolefin (the component of the wax dispersant having affinity for the wax) is adequate, and the wax is easy to disperse in the toner. When the wax and wax dispersant are dispersed in the toner, sufficient hydrophobicity is obtained in the toner, and the charging performance is improved. If the content is at least 20 mass %, sufficient hydrophobicity is obtained and the charging performance is improved because the content of units derived from styrene is sufficient.

Moreover, the crystalline polyester resin used in the present invention is a hybrid resin having crystalline polyester segments and amorphous vinyl segments. Consequently, affinity with the hybrid part of the crystalline polyester is improved if the wax dispersant comprises a styrene acrylic polymer containing styrene. The dispersibility of the crystalline polyester is thus increased to a greater degree than when using conventional wax dispersants, the low-temperature fixability and hydrophobicity of the toner are both improved, and there is less loss of charging performance.

The amount of styrene in the wax dispersant can be detected by a conventional detection method such as NMR or GCMAS.

(Developer)

The toner of the present invention may be used as a one-component developer, but for purposes of further improving dot reproducibility, it is preferably mixed with a magnetic carrier and used as a two-component developer. This is also desirable for obtaining stable images in the long term.

The magnetic carrier may be a common known carrier such as surface oxidized iron powder, unoxidized iron powder, a metal particle of iron, lithium, calcium, magnesium, nickel, copper, zinc, cobalt, manganese, chromium or rare earth, an alloy particle of these, oxide particle, a magnetic body such as a ferrite, or a resin carrier with a dispersed magnetic substance (a so-called resin carrier) containing a magnetic substance and a binder resin that holds the magnetic substance in a dispersed state.

When the toner of the present invention is mixed with a magnetic carrier and used as a two-component developer, good effects can ordinarily be obtained if the carrier mixing ratio (the toner concentration in the two-component developer) is preferably at least 2 mass % and not more than 15 mass %, or more preferably at least 4 mass % and not more than 13 mass %.

(Manufacturing Method)

The procedures for manufacturing the toner of the present invention are explained next. In the present invention, method for manufacturing a toner is not particularly limited, and a known method such as pulverization or suspension polymerization may be used. A pulverization method that can be used by preference in the present invention is explained below.

First, in the raw material mixing step, a crystalline polyester resin, amorphous polyester resin and hydrocarbon wax and the like are precisely weighed, compounded and mixed in the desired quantities as the toner materials. The mixing apparatus may be a Henschel mixer (Nippon Coke & Engineering Co., Ltd.), Super Mixer (Kawata Mfg Co., Ltd.), Ribocone (Okawara Mfg. Co., Ltd.), Nauta mixer, Turbulizer or Cyclomix (Hosokawa Micron Corporation), spiral pin mixer (Pacific Machinery & Engineering Co., Ltd.) or Loedige mixer (Matsubo Corporation) or the like.

The mixed toner materials are then melt kneaded in a melt kneading step, to melt the resins and disperse the colorant and the like in the mixture. The kneading apparatus may be a TEM extruder (Toshiba Machine Co., Ltd.), TEX twin-screw kneader (The Japan Steel Works, Ltd.), PCM kneader (Ikegai Ironworks Corp.), Kneadex (Mitsui Mining Co., Ltd.) or the like, but a continuous kneader such as a single- or twin-screw extruder is preferred over a batch kneader because it is better for continuous production and the like.

After melt kneading, the colored resin composition obtained by melt kneading the toner raw materials is then rolled with two rolls or the like, and cooled by a cooling step using water cooling or the like.

The resulting cooled colored resin composition is then pulverized until the desired particle size is reached in a pulverization step. In the pulverization step, the composition is first coarsely crushed in a crusher, hammer mill, feather mill or the like, and then finely pulverized with a Kryptron system (Kawasaki Heavy Industries, Ltd.), Super Rotor (Nisshin Engineering Inc.) or the like to obtain a toner particle.

The resulting toner particle can then be classified in a classification step to obtain a toner particle of the desired particle diameter. The classifying apparatus may be a Turboplex, Faculty, TSP or TTSP (Hosokawa Micron Corporation), or an Elbow Jet (Nittetsu Mining Co., Ltd.).

Next, the resulting toner particle is spheronized with a heat treatment device such as that shown in FIG. 1 (heat treatment step).

A raw material mixture supplied on a basis of constant feeding by volumetric material supply means 1 is introduced into introduction pipe 3 disposed on the vertical line of the material supply means by a compressed gas that has been adjusted by compressed gas adjustment means 2. After passing through the introduction pipe, the mixture is uniformly dispersed by conical projecting member 4 provided in the center of the material supply means, and conducted by supply pipes 5 extending radially in eight directions to processing chamber 6, where heat treatment is performed.

The flow of the mixture supplied to the processing chamber is regulated by regulating means 9, which regulates the flow of the mixture in the processing chamber. Therefore, the mixture supplied to the processing chamber is heat treated while circulating inside the treatment chamber, and then cooled.

The heat for heat treating the supplied mixture is supplied by heat air supply means 7 and distributed by distribution member 12, and hot air is circulated spirally and introduced into the processing chamber by circulating member 13 for circulating hot air. In this configuration, the circulating member 13 for circulating the hot air has multiple blades, and the circulation of the hot air can be controlled by changing the number and angle of the blades. The hot air supplied inside the processing chamber has a temperature of preferably 100° C. to 300° C. or more preferably 130° C. to 170° C. at the outlet of hot air supply means 7. If the temperature at the outlet of the hot air supply means is within this range, melt adhesion and coalescence of toner particles due to excessive heating of the mixture can be prevented while allowing uniform spheronization of the toner particle. The hot air is supplied from hot air supply means outlet 11.

The heat-treated toner particle is then cooled by cool air supplied from cool air supply means 8, with the temperature of the air supplied from cool air supply means 8 being preferably −20° C. to 30° C. If the temperature of the cool air is within this range, the toner particle can be cooled efficiently, and melt adhesion and coalescence of toner particles can be prevented without inhibiting uniform spheronization of the mixture. The absolute water content of the cool air is preferably at least 0.5 g/m$^3$ and not more than 15.0 g/m$^3$.

Next, the cooled toner particle is collected by collection means 10 at the bottom end of the processing chamber. A blower (not shown) is provided at the end of the collection means to transport the particles by suction.

Powder particle supply port 14 is provided so that the circulating direction of the supplied mixture is the same as the circulating direction of the hot air, and the collection means 10 of the surface treatment apparatus is provided on the outer circumference of the processing chamber so as to maintain the circulating direction of the circulating powder particles. The apparatus is also designed so that the cool air supplied from cool air supply means 8 is supplied horizontally and tangentially from the outer circumference of the apparatus to the inner circumferential surface of the processing chamber.

The circulating direction of the toner particles supplied from the powder supply port, the circulating direction of the cool air supplied from the cool air supply means and the circulating direction of the hot air supplied from the hot air supply means are all the same. Consequently, the circulating flow in the apparatus is reinforced without creating turbulence in the processing chamber, and strong centrifugal force is applied to the toner particle, further improving the dispersion of the toner particles and resulting in toner particles with a uniform shape and few combined particles.

An inorganic fine particle or the like may also be added as necessary to the resulting toner particle before the heat treatment step. An inorganic fine particle may be added either before or after heat treatment. As a method of adding the inorganic fine particle or the like to the toner particle, for example the toner particle and various known external additives may be compounded in specific amounts, and stirred and mixed using, as an external unit, a high speed stirrer that applies shearing force to powder, such as a Henschel mixer, Mechano Hybrid (Nippon Coke & Engineering Co., Ltd.), Super Mixer, Nobilta (Hosokawa Micron Corporation) or the like.

When coarse particles remain after heat treatment, there may be further step of removing coarse particles by classification. The classifier for removing the coarse particle may be a Turboplex, TSP or TTSP (Hosokawa Micron Corporation) or an Elbow Jet (Nittetsu Mining Co., Ltd.).

Moreover, a sieving machine such as an Ultrasonic (Koei Sangyo Co., Ltd.), a Resonasieve or Gyro Sifter (Tokuju Corporation), a Turbo Screener (Turbo Kogyo Co., Ltd.) or a Hi-Bolter (Toyo Hitec Co., Ltd.) for example may also be used to sieve coarse particles and the like as necessary after heat treatment.

The heat treatment step may also be performed after the fine pulverization, or after classification.

The average circularity of the toner of the present invention is preferably at least 0.960 and not more than 1.000, or more preferably at least 0.965 and not more than 0.975. If the average circularity of the toner is within this range, the transfer efficiency of the toner is improved. The average circularity of the toner can be controlled by controlling the heat treatment temperature and the air flow of the hot air.

The methods for measuring the various physical properties of the toner and the raw materials of the toner are explained below.

(Measuring Glass Transition Temperature (Tg) of Resin)

The glass transition temperature of the resin is measured in accordance with ASTM D3418-82 using a Q1000 differential scanning calorimeter (TA Instruments).

The melting points of indium and zinc are used for temperature correction of the device detection part, and the heat of fusion of indium is used for correction of the calorific value.

Specifically, about 5 mg of resin is weighed precisely and placed in an aluminum pan, and using an empty aluminum plan for reference, measurement is performed at a ramp rate of 10° C./minute within the measurement range of 30° C. to 200° C. The temperature is first raised to 180° C., held for 10 minutes, lowered to 30° C., and then raised again. A change in specific heat is obtained within the temperature range of 30° C. to 100° C. during this second temperature increase. The temperature at the point of intersection between the differential thermal curve and a line midway between the baselines prior to and subsequent to the appearance of the change in specific heat is taken as the glass transition temperature (Tg).

(Measuring DSC Endothermy (ΔH) of Wax and Crystalline Polyester Resin (CPES))

The peak temperatures (Tp) of the maximum endothermic peaks of the wax, crystalline polyester resin, toner and the like of the present invention are measured under the following conditions using a DSC Q1000 (TA Instruments).

Ramp rate: 10° C./minute

Measurement start temperature: 20° C.

Measurement end temperature: 180° C.

The melting points of indium and zinc are used for temperature correction of the device detection part, and the heat of fusion of indium is used for correction of the calorific value.

Specifically, about 5 mg of sample is weighed precisely, placed in a silver pan, and measured once. An empty silver pan is used for reference.

When a toner is used as the sample and the maximum endothermic peak (maximum endothermic peak derived from amorphous polyester resin) does not overlap with the endothermic peak of a resin other than the wax and crystalline polyester resin, the endotherm of the resulting maximum endothermic peak is treated as is as the endotherm of the maximum endothermic peak derived from the wax and crystalline polyester resin. If a toner is used as the sample but the endothermic peak of a resin other than the wax and amorphous polyester resin overlaps with the maximum endothermic peak of the amorphous polyester resin, on the other hand, the endotherm derived from the resin other than the wax and amorphous polyester resin must be subtracted from the endotherm of the resulting maximum endothermic peak.

The maximum endothermic peak is the peak at which the endotherm is the greatest when there are multiple peaks. The endotherm (ΔH) of the maximum endothermic peak is determined from the area of the peak by calculation using the analysis software attached to the device.

(Weight-Average Molecular Weight of Crystalline Polyester Resin)

The weight-average molecular weight of the crystalline polyester resin is measured as follows by gel permeation chromatography (GPC).

First, 0.03 g of the crystalline polyester resin is dispersed and dissolved in 10 ml of o-dichlorobenzene, and left standing for 24 hours at 135° C. to dissolve the resin. The resulting solution is then filtered with a 0.2 μm pore diameter solvent-resistant membrane filter (Sample Pretreatment Cartridge, Tosoh Corporation) to obtain a sample solution. Measurement is performed under the following conditions using this sample solution.

(Analysis Conditions)

Separation column: Shodex (TSK GMHHR-H HT20)×2

Column temperature: 135° C.

Mobile phase solvent: o-dichlorobenzene

Mobile phase flow rate: 1.0 ml/minute

Sample concentration: about 0.3%

Injection volume: 300 μl

Detector: Shodex RI-71 differential refractive index detector

A molecular weight calibration curve prepared using standard polystyrene resin (Tosoh Corporation TSK standard polystyrene F-850, F-450, F-288, F-128, F-80, F-40, F-20, F-10, F-4, F-2, F-1, A-5000, A-2500, A-1000, A-500) is used for calculating the molecular weights of the samples.

(Measuring Weight-Average Molecular Weight of Amorphous Vinyl Part of Crystalline Polyester Resin and Mass Ratio of Crystalline Polyester Segments and Amorphous Vinyl Segments in Crystalline Polyester Resin)

The molecular weight of the amorphous vinyl part of the crystalline polyester resin and the mass ratio of the crystalline polyester segments and amorphous vinyl segments in the crystalline resin are measured by hydrolyzing the polyester segments of the crystalline polyester resin.

Specifically, 50 ml of dioxane and 10 ml of a 10 mass % potassium hydroxide aqueous solution are added to 300 mg of crystalline polyester resin, and shaken for 6 hours at 70° C. at a rate of roughly two returns per second with a commercial horizontal shaker to hydrolyze the polyester segments. The solvent is then distilled off under reduced pressure, and the product is dried for 24 hours in a 90° C. atmosphere under reduced pressure to prepare a sample for measuring the molecular weight of the vinyl part. The mass of the resulting measurement sample is given as A (mg). The mass ratio (mass %) of the amorphous vinyl segments in the crystalline polyester resin is then calculated according to the following formula.

$$\text{Mass ratio (mass \%) of amorphous vinyl segments in crystalline polyester resin} = A/300 \times 100$$

0.03 g of the measurement sample is then dispersed and dissolved in 10 ml of o-dichlorobenzene, and left to dissolve for 24 hours at 135° C. The resulting solution is then filtered with a 0.2 μm pore diameter solvent-resistant membrane filter (Sample Pretreatment Cartridge, Tosoh Corporation) to obtain a sample solution. Analysis is then performed with the resulting solution under conditions similar to those used in measuring the weight-average molecular weight of the crystalline polyester resin above.

(Measuring Molecular Weight of Resin by GPC)

The molecular weight distribution of the THF-soluble component of the resin is measured as follows by gel permeation chromatography (GPC).

The toner is first dissolved in tetrahydrofuran (THF) at room temperature over the course of 24 hours. The resulting solution is then filtered with a 0.2 μm pore diameter solvent-resistant membrane filter (Sample Pretreatment Cartridge, Tosoh Corporation) to obtain a sample solution. The concentration of THF-soluble components in the sample solution is adjusted to about 0.8 mass %. Measurement is performed under the following conditions using this sample solution.

Equipment: HLC8120 GPC (Detector: RI) (Tosoh Corporation)

Columns: Shodex KF-801, 802, 803, 804, 805, 806, 807 (septuplicate, Showa Denko K.K.)

Eluent: Tetrahydrofuran (THF)

Flow rate: 1.0 ml/minute

Oven temperature: 40.0° C.

Sample injection volume: 0.10 ml

A molecular weight calibration curve prepared using standard polystyrene resin (for example product name "TSK standard polystyrene F-850, F-450, F-288, F-128, F-80, F-40, F-20, F-10, F-4, F-2, F-1, A-5000, A-2500, A-1000, A-500" (Tosoh Corporation)) is used for calculating the molecular weight of each sample.

(Method for Measuring Softening Point of Resin)

The softening point of the resin is measured using a constant load extrusion type capillary rheometer (Flow Tester CFT-500D flow characteristics evaluation device (Shimadzu Corporation)) in accordance with the manual attached to the device. With this device, a constant load is applied with a piston from the top of the measurement sample as the temperature of the measurement sample packed in a cylinder is raised to melt the sample, the melted measurement sample is extruded from a die at the bottom of the cylinder, and a flow curve is obtained showing the relationship between temperature and the amount of descent of the piston during this process.

In the present invention, the softening point is the "melting temperature by the ½ method" as described in the manual attached to the Flow Tester CFT-500D flow characteristics evaluation device. The melting temperature by the ½ method is calculated as follows. First, ½ the difference between the descent of the piston upon completion of outflow (Smax) and the descent of the piston at the beginning of outflow (Smin) is calculated and given as X (X=(Smax−Smin)/2). The temperature in the flow curve at which X is the descent of the piston is given as the melting point by the ½ method.

For the measurement sample, about 1.0 g of resin is compression molded for about 60 seconds at about 10 MPa in a 25° C. environment with a tablet molding compressor (for example, NT-100H, NPa System Co., Ltd.) to obtain a cylinder about 8 mm in diameter.

The CFT-500D measurement conditions are as follows.

Test mode: Heating method

Initial temperature: 50° C.

Achieved temperature: 200° C.

Measurement interval: 1.0° C.

Ramp rate: 4.0° C./minute

Piston cross-section: 1.000 $cm^2$

Test load (piston load): 10.0 kgf (0.9807 MPa)

Preheating time: 300 seconds

Die hole diameter: 1.0 mm

Die length: 1.0 mm (Method for Measuring Weight-Average Particle Diameter (D4) of Toner Particle)

The weight-average particle diameter (D4) of the toner particle is measured with 25,000 effective measurement channels with a Coulter Counter Multisizer (Trademark) 3 (Beckman Coulter, Inc.) precision particle size distribution measurement device using the pore electrical resistance method and equipped with a 100 μm aperture tube, using the Multisizer 3 Version 3.51 dedicated software (Beckman Coulter, Inc.) attached to the device for setting the measurement conditions and analyzing the measurement data, and the measurement data are analyzed and used to calculate the particle diameter.

A solution of special-grade sodium chloride dissolved to a concentration of about 1 mass % in ion-exchange water, such as "Isoton II" (Beckman Coulter, Inc.), may be used as the electrolytic solution for measurement.

The following settings are performed on the dedicated software prior to measurement and analysis.

On the "Change Standard Operating Method (SOM)" screen of the dedicated software, the total count in control mode is set to 50,000 particles, the number of measurements to one, and the Kd value to a value obtained using "Standard Particles 10.0 μm" (Beckman Coulter, Inc.). The threshold and noise level are set automatically by pressing the threshold/noise level measurement button. The current is set to 1,600 μA, the gain to 2 and the electrolyte to Isoton II, and a check is entered for aperture tube flush after measurement.

On the "Conversion Setting from Pulse to Particle Diameter" screen of the dedicated software, the bin interval is set at the logarithmic particle diameter, the particle diameter bin is set at the 256 particle diameter bin, and the range of the particle diameter is set at 2 μm to 60 μm.

The specific measurement methods are as follows.

(1) About 200 ml of the aqueous electrolytic solution is placed in a 250 ml glass round-bottomed beaker dedicated to the Multisizer 3, set on a sample stand, and stirred with a stirrer rod counterclockwise at a rate of 24 rotations/second. Contamination and bubbles in the aperture tube are removed by means of the "Aperture flush" function of the analytical software.

(2) Approximately 30 ml of the aqueous electrolytic solution is placed in a 100 ml glass flat-bottom beaker, and approximately 0.3 ml of a diluted solution of "Contaminon N" (a 10 mass % aqueous solution of a pH 7 neutral detergent for washing precision measurement equipment, comprising a nonionic surfactant, an anionic surfactant and an organic builder, made by Wako Pure Chemical Industries, Ltd.) diluted 3 times by mass with ion exchange water is added thereto as a dispersant.

(3) A predetermined amount of ion-exchange water is placed in a water bath of an ultrasonic disperser "Ultrasonic Dispersion System Tetora 150" (Nikkaki Bios Co., Ltd.) with an electric output of 120 W, in which two oscillators with an oscillation frequency of 50 kHz are built-in with the phases of the oscillators shifted by 180° to one other. About 2 ml of the Contaminon N is added to the water bath.

(4) The beaker of (2) is set in a beaker fixing hole of the ultrasonic disperser, and the ultrasonic disperser is operated. The height position of the beaker is adjusted so as to maximize the resonance state of the surface of the electrolytic solution in the beaker.

(5) With the electrolytic solution in the beaker of (4) exposed to ultrasound waves, approximately 10 mg of the toner is added little by little to the electrolytic solution, and dispersed. Ultrasonic dispersion treatment is continued for a further 60 seconds. During the ultrasonic dispersion, the temperature of the water in the water bath is properly adjusted so as to be at least 10° C. and not more than 40° C.

(6) Using a pipette, the electrolytic solution of (5) with the toner dispersed therein is added dropwise to the round-bottom beaker of (1) disposed on the sample stand, and the measurement concentration is adjusted so as to be approximately 5%. Measurement is then performed until the number of measured particles reaches 50,000.

(7) The measurement data is analyzed with the dedicated software attached to the apparatus, and the weight-average particle diameter (D4) is calculated. The weight-average particle diameter (D4) is the "average diameter" on the analysis/volume statistical value (arithmetic average) screen when graph/vol % is set by the dedicated software.

(Method for Measuring Average Circularity)

The average circularity of the toner is measured with a FPIA-3000 flow particle imaging instrument (Sysmex Corporation), under the measurement and analysis conditions for calibration operations.

The specific measurement methods are as follows. First, about 20 ml of ion-exchange water from which solid impurities and the like have been removed in advance are placed in a glass container. Approximately 0.2 ml of a diluted solution of "Contaminon N" (a 10 mass % aqueous solution of a pH 7 neutral detergent for washing precision measurement equipment, comprising a nonionic surfactant, an anionic surfactant and an organic builder, made by Wako Pure Chemical Industries, Ltd.) diluted 3 times by mass with ion exchange water is then added thereto as a dispersant. About 0.02 g of the measurement sample is then dispersed for 2 minutes with an ultrasound disperser, whereby a measurement dispersion is produced. During this process, the dispersion is cooled appropriately so that the temperature is at least 10° C. and not more than 40° C. Using a tabletop ultrasound cleaner and disperser with an oscillation frequency of 50 kHz and an electrical output of 150 W (VS-150, Velvo-Clear) as the ultrasound disperser, a specific amount of ion-exchange water is placed in a water bath, and about 2 ml of the previous Contaminon N is then added to the water bath.

Measurement is performed using the previous flow particle imaging instrument with a mounted standard objective lens (10×), using Particle Sheath "PSE-900A" (Sysmex Corporation) as the sheath solution. The dispersion prepared by the procedures described above is introduced into the flow particle imaging instrument, and 3000 toner particles are measured in total count mode in HPF measurement mode. The average circularity of the toner is then determined with a binarization threshold of 85% during particle analysis, and with the range of analyzed particle diameters limited to equivalent circle diameters of at least 1.985 μm and less than 39.69 μm.

Prior to the start of measurement, automatic focal point adjustment is performed with standard latex particles (Duke Scientific Corporation "Research and Test Particles Latex Microsphere Suspensions 5200A", diluted with ion-exchange water). Preferably, focal point adjustment is also performed every two hours after the start of measurement.

The flow particle imaging instrument used in the examples of this application was calibrated by Sysmex Corporation and had a calibration certificate issued by Sysmex Corporation. Measurement was performed under the measurement and analysis conditions established at the time of certification except that the range of analyzed particle diameters was limited to equivalent circle diameters of at least 1.985 μm and less than 39.69 μm.

(Separation of Crystalline Polyester Resin from Toner)

The toner was added to methyl ethyl ketone (MEK), left for a few hours at 25° C., thoroughly stirred to mix the toner and the MEK, and then left standing for at least another 12 hours until no clumps remained in the sample. The resulting solution was centrifuged for 20 minutes at 3,500 rpm using a H-18 centrifuge (Kokusan Co. Ltd.), and the solid component was collected and dried.

The dried sample was dissolved in MEK with heating at 75° C., and the crystalline polyester resin was obtained from the supernatant separated by centrifugation.

EXAMPLES

The present invention is explained in further detail below using examples. The present invention is not limited by these examples. Unless otherwise specified, parts and percentage values in the examples below are based on mass.

(Manufacturing Example of Amorphous Polyester Resin)

| | |
|---|---|
| Polyoxypropylene(2.2)-2,2-bis(4-hydroxyphenyl)propane: | 71.7 mass parts |
| Terephthalic acid: | 25.1 mass parts |
| Tin 2-ethylhexanoate: | 0.5 mass parts |

These materials were weighed into a reaction tank equipped with a cooling pipe, a stirrer, a nitrogen introduction pipe and a thermocouple. Nitrogen gas was substituted inside the flask, the temperature was raised gradually with stirring, and the mixture was reacted for 2 hours with stirring at 200° C.

The pressure inside the reaction tank was lowered to 8.3 kPa and maintained for 1 hour, after which the mixture was cooled to 180° C. and returned to atmospheric pressure.

| | |
|---|---|
| Trimellitic anhydride: | 3.2 mass parts |
| Tert-butyl catechol (polymerization inhibitor): | 0.1 mass parts |

These materials were then added, the pressure inside the reaction tank was lowered to 8.3 kPa, the mixture was reacted for 8 hours with the temperature maintained at 160° C., and once the softening point was confirmed to be 120° C. as measured in accordance with ASTM D36-86, the temperature was lowered to stop the reaction and obtain an amorphous polyester resin.

(Manufacturing Example of Crystalline Polyester Resin 1)

118 g of 1,6-hexanediol, 230 g of dodecanedioic acid, 36.2 g of styrene, 2.5 g of acrylic acid and 3.0 g of dicumyl peroxide were added to a pressure-resistant reactor equipped with a drop funnel, a Liebig cooling pipe and a stirrer in a nitrogen atmosphere, heated to 170° C., and reacted for 10 hours. The pressure during this process was 8.3 kPa.

2.0 g of tin octylate was then added, the mixture was heated to 200° C. and reacted for 8 hours, and the temperature was then raised to 210° C. over the course of 8 hours.

The reaction tank was then gradually opened to restore the pressure to normal pressure, and one or more aliphatic compounds (stearic acid in this case) selected from the group consisting of the aliphatic monocarboxylic acids and aliphatic monoalcohols shown in Table 1 was added in the amount of 7.0 mol parts per 100.0 mol parts of the raw material monomers of the crystalline polyester segments, and reacted for 2 hours at 200° C. under normal pressure.

The reaction tank was then depressurized again to 5 kPa or less, and the mixture was reacted for 3 hours at 200° C. to obtain a crystalline polyester resin 1 having the molecular weight shown in Table 1. The crystalline polyester resin 1 exhibited a clear endothermic peak in differential scanning calorimetry.

(Manufacturing Examples of Crystalline Polyester Resins 2 to 18)

Crystalline polyester resins 2 to 18 were obtained by the same operations as in the manufacturing example of crystalline polyester resin 1 except that the mass ratio of the crystalline segments and amorphous segments, the acid component, the alcohol component, the weight-average molecular weight (Mw) of the crystalline polyester segments, the weight-average molecular weight (Mw) of the amorphous vinyl segments, and the compounds bound to the ends of the molecular chains of the amorphous vinyl segments and crystalline polyester segments were changed appropriately as shown in Table 1. Crystalline polyester resins 2 to 18 exhibited clear endothermic peaks in differential scanning calorimetry.

TABLE 1

| Crystalline polyester resin | Crystalline segments/ amorphous segments (mass ratio) | Acid component | Alcohol component | Weight-average molecular weight of crystalline polyester segments (Mw) | Weight-average molecular weight of amorphous vinyl segments (Mw) | Amorphous vinyl segments | Compound bound to end of molecular chain of crystalline polyester segments |
|---|---|---|---|---|---|---|---|
| Crystalline polyester resin 1 | 90/10 | Dodecanedioic acid (C12) | 1,6-hexanediol (C6) | 20200 | 22600 | StAc | Stearic acid (C18) |
| Crystalline polyester resin 2 | 90/10 | Dodecanedioic acid (C12) | 1,6-hexanediol (C6) | 20100 | 22600 | StAc | Stearyl alcohol (C18) |
| Crystalline polyester resin 3 | 90/10 | Dodecanedioic acid (C12) | 1,6-hexanediol (C6) | 20300 | 22600 | StAc | Arachidonic acid (C20) |
| Crystalline polyester resin 4 | 90/10 | Dodecanedioic acid (C12) | 1,6-hexanediol (C6) | 20400 | 22600 | StAc | Capric acid (C10) |
| Crystalline polyester resin 5 | 90/10 | Dodecanedioic acid (C12) | 1,6-hexanediol (C6) | 20200 | 22600 | StAc | Heneicosylic acid (C21) |
| Crystalline polyester resin 6 | 90/10 | Dodecanedioic acid (C12) | 1,6-hexanediol (C6) | 20100 | 22600 | StAc | Pelargonic acid (C9) |
| Crystalline polyester resin 7 | 90/10 | Dodecanedioic acid (C12) | 1,6-hexanediol (C6) | 20200 | 22600 | StAc | None |
| Crystalline polyester resin 8 | 90/10 | Dodecanedioic acid (C12) | 1,6-hexanediol (C6) | 44600 | 38800 | StAc | None |
| Crystalline polyester resin 9 | 90/10 | Dodecanedioic acid (C12) | 1,6-hexanediol (C6) | 5100 | 5200 | StAc | None |
| Crystalline polyester resin 10 | 90/10 | Dodecanedioic acid (C12) | 1,6-hexanediol (C6) | 52200 | 54300 | StAc | None |
| Crystalline polyester resin 11 | 90/10 | Adipic acid (C6) | 1,12-dodecandiol (C12) | 53100 | 50200 | StAc | None |
| Crystalline polyester resin 12 | 90/10 | Sebacic acid (C10) | 1,10-decanediol (C10) | 50300 | 53300 | StAc | None |
| Crystalline polyester resin 13 | 90/10 | Sebacic acid (C10) | 1,6-hexanediol (C6) | 51000 | 51200 | StAc | None |
| Crystalline polyester resin 14 | 90/10 | Fumaric acid (C4) | 1,6-hexanediol (C6) | 52400 | 51200 | StAc | None |
| Crystalline polyester resin 15 | 70/30 | Fumaric acid (C4) | 1,6-hexanediol (C6) | 52200 | 54300 | StAc | None |
| Crystalline polyester resin 16 | 98/2 | Fumaric acid (C4) | 1,6-hexanediol (C6) | 52200 | 54300 | StAc | None |
| Crystalline polyester resin 17 | 65/45 | Fumaric acid (C4) | 1,6-hexanediol (C6) | 52200 | 54300 | StAc | None |
| Crystalline polyester resin 18 | 100/0 | Fumaric acid (C4) | 1,6-hexanediol (C6) | 52200 | None | None | None |

(Manufacturing Example of Wax Dispersant 1)

300 parts of xylene and 10 parts of polypropylene (molecular weigh 6400, melting point 81° C.) were placed in an autoclave reaction tank with an attached thermometer and stirrer and thoroughly dissolved, nitrogen was substituted, and a mixed solution of 42.0 parts of styrene, 40.0 parts of cyclohexyl methacrylate, 8.0 parts of butyl acrylate and 250 parts of xylene was added dropwise at 180° C. for 3 hours and polymerized. This was held at this temperature for 30 minutes, and the solvent was removed to obtain a wax dispersant 1. The composition of the resulting wax dispersant is shown in Table 2.

(Manufacturing Examples of Wax Dispersants 2 to 7)

Wax dispersants 2 to 7 were obtained by the same operations as in the manufacturing example of wax dispersant 1 except that the number of parts of the polyolefin and the composition and number of parts of the styrene acrylic polymer were changed appropriately as shown in Table 2. The compositions of the resulting wax dispersants are shown in Table 2.

TABLE 2

| | Polyolefin | | Composition and parts of styrene acrylic polymer | | | | |
|---|---|---|---|---|---|---|---|
| | | | Saturated alicyclic compound | | | | |
| Wax dispersant | Type | Mass parts | Type | Mass parts | Mass parts of styrene | Other compound | Mass parts |
| Wax dispersant 1 | Polypropylene | 10 | Cyclohexyl methacrylate | 5 | 75 | Butyl acrylate | 10 |
| Wax dispersant 2 | Polypropylene | 10 | Cyclohexyl methacrylate | 40 | 40 | Butyl acrylate | 10 |
| Wax dispersant 3 | Polypropylene | 10 | Cyclohexyl methacrylate | 60 | 20 | Butyl acrylate | 10 |
| Wax dispersant 4 | Polypropylene | 5 | Cyclohexyl methacrylate | 5 | 90 | — | — |
| Wax dispersant 5 | Polypropylene | 5 | Cyclohexyl methacrylate | 2 | 93 | — | — |
| Wax dispersant 6 | Polypropylene | 10 | Cyclohexyl methacrylate | 65 | 15 | Butyl acrylate | 10 |
| Wax dispersant 7 | Polypropylene | 10 | — | — | 80 | Butyl acrylate | 10 |

(Manufacturing Example of Toner 1)

| | |
|---|---|
| Amorphous polyester resin | 100 mass parts |
| Crystalline polyester resin 1 | 15 mass parts |
| Wax dispersant 1 | 5 mass parts |
| Fischer-Tropsch wax (maximum endothermic peak temperature 78° C.) | 5 mass parts |
| C.I. Pigment Blue 15:3 | 7 mass parts |
| 3,5-di-t-butylsalicylic acid aluminum compound (Bontron E101, Orient Chemical Industries Co., Ltd.) | 0.3 mass parts |

These materials were mixed with a Henschel mixer (FM-75, Mitsui Mining Co., Ltd.) for 5 minutes at a rotational speed of 20 $s^{-1}$, and then kneaded with a twin-screw kneader (PCM-30, Ikegai Corp) set to 150° C. The resulted kneaded product was cooled, and coarsely crushed to 1 mm or less with a hammer mill to obtain a coarsely crushed product. The coarsely crushed product was then finely pulverized with a mechanical pulverizer (T-250, Turbo Kogyo Co., Ltd.). This was then classified with a Faculty F-300 (Hosokawa Micron Corporation) to obtain a toner particle 1. For the operating conditions, the classifying rotor speed was 130 $s^{-1}$, and the dispersing rotor speed was 120 $s^{-1}$.

The resulting toner particle 1 was heat treated with the surface treatment apparatus shown in FIG. 1 to obtain a heat-treated toner particle. The operating conditions were feed=5 kg/hour, hot air temperature=160° C., hot air flow rate=6 $m^3$/minute, cool air temperature=−5° C., cool air flow rate=4 $m^3$/minute, blower flow rate=20 $m^3$/minute, injection air flow rate=1 $m^3$/minute.

1.0 mass parts of hydrophobic silica (BET: 200 $m^2$/g) and 1.0 mass parts of titanium oxide fine particles surface treated with isobutyltrimethoxysilane (BET: 80 $m^2$/g) were mixed into 100 mass parts of the heat-treated toner particle with a Henschel mixer (FM-75, Mitsui Miike Chemical Engineering Machinery, Co., Ltd.) at a rotational speed of 30 $s^{-1}$ for a rotation time of 10 minutes, to obtain a toner 1. The toner 1 had a weight-average particle diameter (D4) of 6.5 μm, and an average circularity of 0.970. The physical properties of the toner are shown in Table 3-1 and Table 3-2.

(Manufacturing Examples of Toners 2 to 31)

Toners 2 to 31 were obtained by the same operations as in the manufacturing example of toner 1 except that the crystalline polyester resin, crystalline polyester resin content, hydrocarbon wax content, relationship between the contents of the crystalline polyester resin (CPES) and hydrocarbon wax (WAX), type of wax dispersant and average circularity were changed appropriately as shown in Table 3-1 and Table 3-2. No heat treatment step was performed in the case of toner 30.

TABLE 3-1

| Toner | Crystalline polyester resin | Crystalline polyester resin content Mass parts | Hydrocarbon wax content Mass parts | Relationship between contents of crystalline polyester resin (CPES) and hydrocarbon wax (WAX) Mass parts | Wax dispersant | Average circularity |
|---|---|---|---|---|---|---|
| Toner 1 | Crystalline polyester resin 1 | 15.0 | 5.0 | CPES > WAX | Wax dispersant 1 | 0.970 |
| Toner 2 | Crystalline polyester resin 1 | 15.0 | 5.0 | CPES > WAX | Wax dispersant 2 | 0.970 |
| Toner 3 | Crystalline polyester resin 1 | 15.0 | 5.0 | CPES > WAX | Wax dispersant 3 | 0.970 |
| Toner 4 | Crystalline polyester resin 1 | 15.0 | 5.0 | CPES > WAX | Wax dispersant 4 | 0.970 |

TABLE 3-1-continued

| Toner | Crystalline polyester resin | Crystalline polyester resin content Mass parts | Hydrocarbon wax content Mass parts | Relationship between contents of crystalline polyester resin (CPES) and hydrocarbon wax (WAX) Mass parts | Wax dispersant | Average circularity |
|---|---|---|---|---|---|---|
| Toner 5 | Crystalline polyester resin 1 | 15.0 | 5.0 | CPES > WAX | Wax dispersant 5 | 0.970 |
| Toner 6 | Crystalline polyester resin 1 | 15.0 | 5.0 | CPES > WAX | Wax dispersant 6 | 0.970 |
| Toner 7 | Crystalline polyester resin 1 | 15.0 | 5.0 | CPES > WAX | Wax dispersant 7 | 0.970 |
| Toner 8 | Crystalline polyester resin 1 | 15.0 | 5.0 | CPES > WAX | Wax dispersant 7 | 0.960 |
| Toner 9 | Crystalline polyester resin 1 | 15.0 | 5.0 | CPES > WAX | Wax dispersant 7 | 0.955 |
| Toner 10 | Crystalline polyester resin 2 | 15.0 | 5.0 | CPES > WAX | Wax dispersant 7 | 0.955 |
| Toner 1 1 | Crystalline polyester resin 3 | 15.0 | 5.0 | CPES > WAX | Wax dispersant 7 | 0.955 |
| Toner 12 | Crystalline polyester resin 4 | 15.0 | 5.0 | CPES > WAX | Wax dispersant 7 | 0.955 |
| Toner 13 | Crystalline polyester resin 5 | 15.0 | 5.0 | CPES > WAX | Wax dispersant 7 | 0.955 |
| Toner 14 | Crystalline polyester resin 6 | 15.0 | 5.0 | CPES > WAX | Wax dispersant 7 | 0.955 |
| Toner 15 | Crystalline polyester resin 7 | 15.0 | 5.0 | CPES > WAX | Wax dispersant 7 | 0.955 |

TABLE 3-2

| Toner | Crystalline polyester resin | Crystalline polyester resin content Mass parts | Hydrocarbon wax content Mass parts | Relationship between contents of crystalline polyester resin (CPES) and hydrocarbon wax (WAX) Mass parts | Wax dispersant | Average circularity |
|---|---|---|---|---|---|---|
| Toner 16 | Crystalline polyester resin 7 | 10.0 | 5.0 | CPES > WAX | Wax dispersant 7 | 0.955 |
| Toner 17 | Crystalline polyester resin 7 | 5.0 | 5.0 | CPES = WAX | Wax dispersant 7 | 0.955 |
| Toner 18 | Crystalline polyester resin 7 | 16.0 | 16.0 | CPES = WAX | Wax dispersant 7 | 0.955 |
| Toner 19 | Crystalline polyester resin 7 | 0.9 | 5.0 | CPES < WAX | Wax dispersant 7 | 0.955 |
| Toner 20 | Crystalline polyester resin 8 | 0.9 | 5.0 | CPES < WAX | Wax dispersant 7 | 0.955 |
| Toner 21 | Crystalline polyester resin 9 | 0.9 | 5.0 | CPES < WAX | Wax dispersant 7 | 0.955 |
| Toner 22 | Crystalline polyester resin 10 | 0.9 | 5.0 | CPES < WAX | Wax dispersant 7 | 0.955 |
| Toner 23 | Crystalline polyester resin 11 | 0.9 | 5.0 | CPES < WAX | Wax dispersant 7 | 0.955 |
| Toner 24 | Crystalline polyester resin 12 | 0.9 | 5.0 | CPES < WAX | Wax dispersant 7 | 0.955 |
| Toner 25 | Crystalline polyester resin 13 | 0.9 | 5.0 | CPES < WAX | Wax dispersant 7 | 0.955 |
| Toner 26 | Crystalline polyester resin 14 | 0.9 | 5.0 | CPES < WAX | Wax dispersant 7 | 0.955 |
| Toner 27 | Crystalline polyester resin 15 | 0.9 | 5.0 | CPES < WAX | Wax dispersant 7 | 0.955 |
| Toner 28 | Crystalline polyester resin 16 | 0.9 | 5.0 | CPES < WAX | Wax dispersant 7 | 0.955 |
| Toner 29 | Crystalline polyester resin 17 | 0.9 | 5.0 | CPES < WAX | None | 0.955 |
| Toner 30 | Crystalline polyester resin 17 | 0.9 | 5.0 | CPES < WAX | None | 0.952 |
| Toner 31 | Crystalline polyester resin 18 | 0.9 | 5.0 | CPES < WAX | None | 0.952 |

(Manufacturing Example of Magnetic Core Particle 1)

Step 1 (Weighing and Mixing Step):

| | |
|---|---|
| $Fe_2O_3$ | 62.7 mass parts |
| $MnCO_3$ | 29.5 mass parts |
| $Mg(OH)_2$ | 6.8 mass parts |
| $SrCO_3$ | 1.0 mass parts |

Ferrite raw materials were weighed to achieve the above compositional ratio of materials. This was then pulverized and mixed for 5 hours in a dry vibratory mill using stainless steel beads ⅛ inch in diameter.

Step 2 (Preliminary Firing Step):

The resulting pulverized product was formed into a roughly 1 mm square pellet in a roller compactor. Coarse powder was removed from this pellet with a 3 mm mesh vibrating screen, fine powder was then removed with a 0.5 mm mesh vibrating screen, and the pellet was fired for 4 hours at 1000° C. with a burner-type firing furnace in a nitrogen atmosphere (oxygen concentration 0.01 vol %) to obtain a pre-fired ferrite. The composition of the resulting pre-fired ferrite was as follows.

$$(MnO)_a(MgO)_b(SrO)_c(Fe_2O_3)_d$$

In the formula above, a=0.257, b=0.117, c=0.007 and d=0.393.

Step 3 (Pulverization Step):

This was pulverized to about 0.3 mm in a crusher, and 30 mass parts of water were added per 100 mass parts of the pre-fired ferrite, which was then pulverized for 1 hour in a wet ball mill with zirconia beads having a diameter of ⅛ inch. This slurry was pulverized for 4 hours in a wet ball mill using alumina beads 1/16 inch in diameter to obtain a ferrite slurry (finely pulverized pre-fired ferrite).

Step 4 (Granulation Step):

1.0 mass parts of polycarbonate ammonium as a dispersant and 2.0 mass parts of polyvinyl alcohol as a binder were added to 100 mass parts of the pre-fired ferrite, and spherical particles were granulated in a spray dryer (manufactured by Ohkawara Kakohki Co., Ltd.). After particle size adjustment, the resulting particles were heated at 650° C. for 2 hours with a rotary kiln to remove the organic components of the dispersant and binder.

Step 5 (Firing Step):

This was heated from room temperature to 1300° C. over the course of 2 hours in an electric furnace in a nitrogen atmosphere (oxygen concentration 1.00 vol %) to control the firing atmosphere, and then fired for 4 hours at 1150° C. The temperature was then lowered to 60° C. over the course of 4 hours, the nitrogen atmosphere was replaced with atmosphere, and the product was removed at a temperature of 40° C. or less.

Step 6 (Selection Step):

Aggregated particles were broken up, low magnetic products were cut with a magnetic dressing, and coarse particles were sifted out with a 250 μm mesh sieve to obtain a magnetic core particle 1 with a 50% particle diameter D50 of 37.0 μm based on volume distribution.

(Preparation of Coating Resin 1)

| | |
|---|---|
| Cyclohexyl methacrylate monomer | 26.8 mass % |
| Methyl methacrylate monomer | 0.2 mass % |
| Methyl methacrylate macromonomer (macromonomer of weight-average molecular weight 5,000 having methacryloyl group at one end) | 8.4 mass % |

-continued

| | |
|---|---|
| Toluene | 31.3 mass % |
| Methyl ethyl ketone | 31.3 mass % |
| Azobisisobutyronitrile | 2.0 mass % |

Of these materials, the cyclohexyl methacrylate, methyl methacrylate, methyl methacrylate macromonomer, toluene and methyl ethyl ketone were added to a four-necked separable flask with an attached reflux condenser, thermometer, nitrogen introduction pipe and stirrer, nitrogen gas was introduced to obtain an adequate nitrogen atmosphere, the mixture was heated to 80° C., the azobisisobutyronitrile was added, and the mixture was refluxed and polymerized for 5 hours. Hexane was poured into the resulting reaction product to precipitate a copolymer, and the precipitate was filtered and vacuum dried to obtain a coating resin 1. 30 mass parts of the resulting coating resin 1 were dissolved in 40 mass parts of toluene and 30 mass parts of methyl ethyl ketone, to obtain a polymer solution 1 (solids 30 mass %).

(Preparation of Coating Resin Solution 1)

| | |
|---|---|
| Polymer solution 1 (resin solids concentration 30%) | 33.3 mass % |
| Toluene | 66.4 mass % |
| Carbon black (Regal 330, Cabot Corporation) | 0.3 mass % |

(primary particle diameter 25 nm, nitrogen adsorption specific surface area 94 $m^2/g$, DBP oil absorption 75 ml/100 g)

These were dispersed for 1 hour with a paint shaker using zirconia beads 0.5 mm in diameter. The resulting dispersion was filtered with a 5.0 μm membrane filter to obtain a coating resin solution 1.

(Manufacturing Example of Magnetic Carrier 1) (Resin Coating Step):

The coating resin solution 1 was added to a vacuum degassing kneader maintained at room temperature in the amount of 2.5 mass parts (of the resin component) per 100 mass parts of the packed core particle 1. This was stirred for 15 minutes at a rotational speed of 30 rpm, and once at least a certain amount (80 mass %) of the solvent had evaporated, the mixture was mixed under reduced pressure as the temperature was raised to 80° C., the toluene was distilled off for 2 hours, and the mixture was then cooled. A magnetic dressing was used to separate the low-magnetic component from the resulting magnetic carrier, which was then passed through a 70 μm sieve, and classified with an air classifier to obtain a magnetic carrier 1 with a 50% particle diameter (D50) of 38.2 μm based on volume distribution.

(Manufacturing Examples of Two-Component Developers 1 to 31)

8.0 mass parts of the toner 1 were added to 92.0 mass parts of the magnetic carrier 1, and mixed with a V-type mixer (V-20, Seishin Enterprise Co., Ltd.) to obtain a two-component developer 1. Two-component developers 2 to 31 were also obtained by the same operations except that the combination of toner and magnetic carrier was changed as shown in Table 4.

TABLE 4

| Example | Two-component developer | Magnetic carrier | Toner |
|---|---|---|---|
| Example 1 | 1 | 1 | 1 |
| Example 2 | 2 | 1 | 2 |

TABLE 4-continued

| Example | Two-component developer | Magnetic carrier | Toner |
|---|---|---|---|
| Example 3 | 3 | 1 | 3 |
| Example 4 | 4 | 1 | 4 |
| Example 5 | 5 | 1 | 5 |
| Example 6 | 6 | 1 | 6 |
| Example 7 | 7 | 1 | 7 |
| Example 8 | 8 | 1 | 8 |
| Example 9 | 9 | 1 | 9 |
| Example 10 | 10 | 1 | 10 |
| Example 11 | 11 | 1 | 11 |
| Example 12 | 12 | 1 | 12 |
| Example 13 | 13 | 1 | 13 |
| Example 14 | 14 | 1 | 14 |
| Example 15 | 15 | 1 | 15 |
| Example 16 | 16 | 1 | 16 |
| Example 17 | 17 | 1 | 17 |
| Example 18 | 18 | 1 | 18 |
| Example 19 | 19 | 1 | 19 |
| Example 20 | 20 | 1 | 20 |
| Example 21 | 21 | 1 | 21 |
| Example 22 | 22 | 1 | 22 |
| Example 23 | 23 | 1 | 23 |
| Example 24 | 24 | 1 | 24 |
| Example 25 | 25 | 1 | 25 |
| Example 26 | 26 | 1 | 26 |
| Example 27 | 27 | 1 | 27 |
| Example 28 | 28 | 1 | 28 |
| Comparative Example 1 | 29 | 1 | 29 |
| Comparative Example 2 | 30 | 1 | 30 |
| Comparative Example 3 | 31 | 1 | 31 |

Example 1

Using a modified image RUNNER ADVANCE C9075 PRO Canon Inc. printer for industrial printing as the image-forming unit, the developing device in the cyan position was filled with the two-component developer 1, an image was formed with the desired toner laid-on level on paper, and the following evaluations were performed. The device was modified so that the fixing temperature and process speed could be set at will. When evaluating image output, the DC voltage $V_{DC}$ of the developer carrier, the charging voltage $V_D$ of the electrostatic latent image carrier and the laser power were adjusted so as to obtain a toner laid-on level on the paper of 0.35 mg/cm$^2$ with a FFh image (solid image). FFh is a value obtained by displaying 256 tones in hexadecimal notation, with 00 h being the first of 256 tones (white background), and FFh the 256th tone (solid part).

Evaluations were performed by the methods shown below, with the results shown in Table 5-1 and Table 5-2.

(Durability)

Paper: CS-680 (68.0 g/m$^2$) (purchased from Canon Marketing Japan Inc.)

Toner laid-on level on paper: 0.35 mg/cm$^2$ (FFh image)

Evaluation image: Chart with image ratio of 100% on the A4 paper

Fixing test environment: High-temperature, high-humidity environment of 30° C./85% RH (hereunder "H/H")

For the durable image output test, 10,000 copies were output on A4 paper using a strip chart with an image ratio of 0.1% (FFh output). The evaluation image above was then output, and the number of white spots in the image was confirmed with the naked eye.

(Evaluation Standard)

A: Fewer than 5 white spots (Excellent)

B: 5 or more and fewer than 10 white spots (Good)

C: 10 or more and fewer than 20 white spots (Acceptable level in the present invention)

D: 20 or more white spots (Not acceptable in the present invention)

(Low-Temperature Fixability)

Paper: CS-680 (68.0 g/m$^2$) (purchased from Canon Marketing Japan Inc.)

Toner laid-on level on paper: 1.20 mg/cm$^2$

Evaluation image: 10 cm$^2$ image positioned in center of the A4 paper

Fixing test environment: Low-temperature, low-humidity environment of 15° C./10% RH (hereunder "L/L")

The DC voltage $V_{DC}$ of the developer carrier, the charging voltage $V_D$ of the electrostatic latent image carrier and the laser power were adjusted so as to obtain the toner laid-on level on the paper described above, and low-temperature fixability was then evaluated with the process speed set to 450 mm/sec and the fixing temperature to 130° C. The image density decrease rate was taken as the evaluation standard for low-temperature fixability. To determine the image density decrease rate, the image density of the center part was first measured with an X-Rite color reflection densitometer (X-Rite, Incorporated 500 series). Next, a load of 4.9 kPa (50 g/cm$^2$) was applied to the area where image density was measured, the fixed image was abraded (5 reciprocating passes) with Silbon paper, and the image density was measured again. The decrease rate (%) in the image density before and after abrasion was then calculated.

(Evaluation Standard)

A: Image density decrease rate less than 1.0% (Excellent)

B: Image density decrease rate 1.0% or more and less than 5.0% (Good)

C: Image density decrease rate 5.0% or more and less than 10.0% (Acceptable level in the present invention)

D: Image density decrease rate 10.0% or more (Not acceptable in the present invention)

(Storability)

5 g of toner was placed in a 100 cc plastic cup and left for 48 hours in a temperature- and humidity-adjustable thermostatic tank (55° C., 41%), and the cohesiveness of the toner after storage was evaluated. Cohesiveness was evaluated based on the residual ratio of toner remaining after being shaken for 10 seconds on a 20 μm mesh with an oscillation of 0.5 mm using a Hosokawa Micron Corporation PT-X powder tester.

(Evaluation Standard)

A: Residual ratio less than 2.0% (Excellent)

B: Residual ratio 2.0% or more and less than 10.0% (Good)

C: Residual ratio 10.0% or more and less than 15.0% (Acceptable level in the present invention)

D: Residual ratio 15.0% or more (Not acceptable in the present invention)

(Transfer Efficiency)

Paper: CS-680 (68.0 g/m$^2$) (purchased from Canon Marketing Japan Inc.)

Toner laid-on level on latent image carrier: 0.35 mg/cm$^2$

Evaluation image: Chart with image ratio of 100% on the A4 paper

Fixing test environment: High-temperature, high-humidity environment of 30° C./85% RH (hereunder "H/H")

When outputting this image, the operation was stopped during development, and the residual toner on the latent image carrier during image formation was peeled off by taping with transparent polyester adhesive tape. The density of an adhesive tape alone affixed to paper was subtracted from the density of the peeled tape affixed to paper to calculate the density difference of each. This was then evaluated according to the following evaluation standard.

The untransferred density was measured with an X-Rite color reflection densitometer (500 series).

A: Density difference less than 0.10 (Excellent)

B: Density difference 0.10 or more and less than 0.15 (Good)

C: Density difference 0.15 or more and less than 0.25 (Acceptable level in the present invention)

D: Density difference 0.25 or more (Not acceptable in the present invention)

(Hot Offset Resistance)

Paper: CS-680 (68.0 g/m$^2$) (purchased from Canon Marketing Japan Inc.)

Toner laid-on level: 0.08 mg/cm$^2$

Evaluation image: 10 cm$^2$ images positioned at both ends of the A4 paper

Fixing test environment: Normal-temperature, low-humidity environment of 23° C./5% RH (hereunder "N/L")

After the unfixed image was prepared, the process speed was set to 450 mm/sec, the fixing temperature was raised from 150° C. in 5° C. increments, and offset resistance was evaluated. First, 10 plain postcards were fed through the center position of the fixing belt, after which the previous unfixed image was fed through. The fogging value was taken as the hot offset evaluation standard. Fogging was calculated according to the following formula from the average reflectance Dr (%) of the evaluation paper before image output and the reflectance Ds (%) of the white part after the fixing test as measured with a reflectometer (Tokyo Denshoku Co., Ltd. Reflectometer Model TC-6DS). Fogging was then evaluated according to the evaluation standard below.

$$\text{Fogging (\%)} = Dr(\%) - Ds(\%)$$

(Evaluation Standard)

A: Less than 0.2% (Excellent)

B: 0.2% or more and less than 0.5% (Good)

C: 0.5% or more and less than 1.0% (Acceptable level in the present invention)

D: 1.0% or more (Not acceptable in the present invention)

(Charging Performance)

The toner on the electrostatic latent image carrier was collected by suction with a metal cylindrical tube and a tubular filter, and the triboelectric charge quantity and laid-on level of the toner were calculated.

Figure 2:
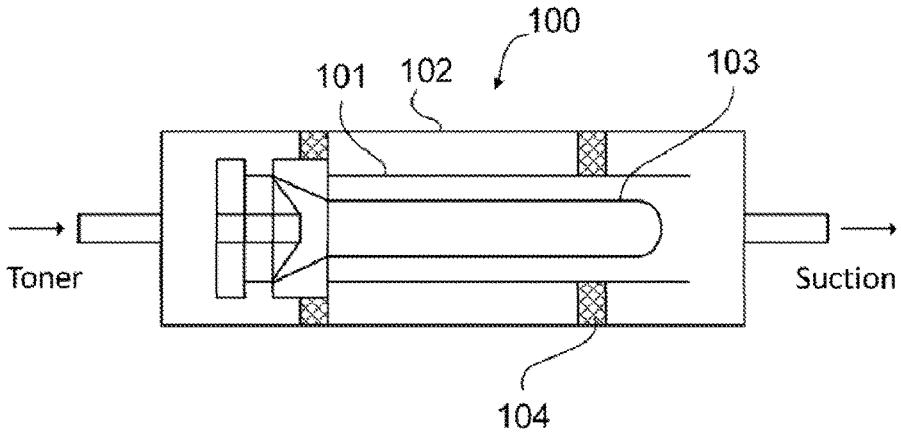
FIG. 2 shows an example of a Faraday cage.

Specifically, the triboelectric charge quantity and laid-on level of the toner on the electrostatic latent image carrier were measured with a Faraday cage as shown in FIG. 2.

The toner on the electrostatic latent image carrier was air suctioned using a Faraday cage 100 provided with inner and outer double cylinders 101 and 102 disposed so that the metal cylinders with different shaft diameters were coaxial, and a filter 103 for accepting toner into the inner cylinder 101.

In the Faraday cage 100, the inner cylinder 101 and outer cylinder 102 are insulated by an insulating member 104, so that when toner is taken into the filter electrostatic induction occurs due to the charge quantity Q of the toner. When a charged body with a charge quantity Q is placed in this inner cylinder, it is as if a metal cylinder with a charge quantity Q exists due to electrostatic induction. The induced charge quantity was measured with an electrometer (Keithley 6517A, Keithley Instruments, Inc.) and the charge quantity Q (mC) divided by the toner mass M (kg) in the cylinder (Q/M) was taken as the triboelectric charge quantity.

The suctioned area S was also measured, and the toner mass M was divided by the suctioned area S (cm$^2$) to obtain the toner laid-on level per unit area.

The rotation of the electrostatic latent image carrier was halted before the toner layer formed on the electrostatic latent image carrier was transferred to the intermediate transfer member, and the toner image on the electrostatic latent image carrier was directly air suctioned and measured.

$$\text{Toner laid-on level (mg/cm}^2) = M/S$$

$$\text{Toner triboelectric charge quantity (mC/kg)} = Q/M$$

The image-forming apparatus was adjusted so that the toner laid-on level on the electrostatic latent image carrier was 0.35 mg/cm$^2$ in a high-temperature, high-humidity environment (30° C., 80% RH), and the toner was suction collected with the aforementioned metal cylindrical tube and tubular filter. The charge quantity Q accumulated on the condenser via the metal cylindrical tube and the mass M of the collected toner were measured, and the charge quantity Q/M per unit mass (mC/kg) was calculated and given as the charge quantity Q/M per unit mass (mC/kg) on the electrostatic latent image carrier (initial evaluation).

Following this evaluation (initial evaluation), the developing device was removed from the apparatus, and left for 48 hours in a high-temperature, high-humidity environment (32.5° C., 80% RH). After this, the developing device was re-mounted on the apparatus, and the charge quantity Q/M per unit mass on the electrostatic latent image carrier was measured again at the same DC voltage $V_{DC}$ as in the initial evaluation (post-standing evaluation).

Given 100% as the charge quantity Q/M per unit mass on the electrostatic latent image carrier in the initial evaluation, the retention rate of the charge quantity Q/M per unit mass on the electrostatic image carrier after 48 hours of standing (post-standing evaluation) was calculated (post-standing evaluation/initial evaluation×100) and evaluated according to the following standard.

(Evaluation Standard)

A: Retention rate at least 80%: Excellent

B: Retention rate at least 70% and less than 80%: Good

C: Retention rate at least 60% and less than 70%: Acceptable level in the present invention D: Retention rate less than 60%: Not acceptable in the present invention Examples 2 to 28, Comparative Examples 1 to 3

Evaluations were performed as in Example 1 but using the two-component developers 2 to 31. The evaluation results are shown in Table 5-1 and Table 5-2.

TABLE 5-1

| | Durability | | Low-temperature fixability | | Storability | |
|---|---|---|---|---|---|---|
| Example | White spots (n) | Evaluation | Density decrease rate (%) | Evaluation | Residual ratio (%) | Evaluation |
| Example 1 | 0 | A | 0.3 | A | 1.2 | A |
| Example 2 | 0 | A | 0.3 | A | 1.2 | A |
| Example 3 | 0 | A | 0.3 | A | 1.2 | A |
| Example 4 | 0 | A | 0.3 | A | 1.2 | A |
| Example 5 | 0 | A | 0.3 | A | 1.2 | A |
| Example 6 | 0 | A | 0.3 | A | 1.2 | A |
| Example 7 | 0 | A | 0.3 | A | 1.2 | A |
| Example 8 | 0 | A | 0.3 | A | 1.3 | A |
| Example 9 | 0 | A | 0.3 | A | 1.3 | A |
| Example 10 | 1 | A | 0.4 | A | 1.5 | A |

TABLE 5-1-continued

| Example | Durability: White spots (n) | Durability: Evaluation | Low-temperature fixability: Density decrease rate (%) | Low-temperature fixability: Evaluation | Storability: Residual ratio (%) | Storability: Evaluation |
|---|---|---|---|---|---|---|
| Example 11 | 1 | A | 0.9 | A | 1.3 | A |
| Example 12 | 1 | A | 0.5 | A | 1.5 | A |
| Example 13 | 2 | A | 1.0 | B | 1.9 | A |
| Example 14 | 2 | A | 0.5 | A | 2.0 | B |
| Example 15 | 3 | A | 2.2 | B | 5.0 | B |
| Example 16 | 3 | A | 3.8 | B | 5.3 | B |
| Example 17 | 4 | A | 4.3 | B | 4.2 | B |
| Example 18 | 4 | A | 4.6 | B | 11.0 | C |
| Example 19 | 5 | B | 5.0 | C | 10.5 | C |
| Example 20 | 6 | B | 6.3 | C | 10.7 | C |
| Example 21 | 6 | B | 4.9 | B | 11.0 | C |
| Example 22 | 7 | B | 6.5 | C | 11.4 | C |
| Example 23 | 7 | B | 6.8 | C | 12.3 | C |
| Example 24 | 8 | B | 6.4 | C | 13.1 | C |
| Example 25 | 8 | B | 6.7 | C | 13.5 | C |
| Example 26 | 9 | B | 7.5 | C | 14.0 | C |
| Example 27 | 10 | C | 7.7 | C | 14.5 | C |
| Example 28 | 14 | C | 8.0 | C | 14.8 | C |
| Comparative Example 1 | 22 | D | 10.5 | D | 15.3 | D |
| Comparative Example 2 | 25 | D | 11.3 | D | 16.2 | D |
| Comparative Example 3 | 32 | D | 15.8 | D | 17.0 | D |

TABLE 5-2

| Example | Transfer efficiency: Density difference | Transfer efficiency: Evaluation | Hot offset resistance: Fogging (%) | Hot offset resistance: Evaluation | Charging performance: Retention rate (%) | Charging performance: Evaluation |
|---|---|---|---|---|---|---|
| Example 1 | 0.08 | A | 0.1 | A | 86 | A |
| Example 2 | 0.08 | A | 0.1 | A | 83 | A |
| Example 3 | 0.08 | A | 0.1 | A | 81 | A |
| Example 4 | 0.08 | A | 0.1 | A | 80 | A |
| Example 5 | 0.08 | A | 0.1 | A | 74 | B |
| Example 6 | 0.08 | A | 0.1 | A | 70 | B |
| Example 7 | 0.08 | A | 0.1 | A | 67 | C |
| Example 8 | 0.14 | B | 0.1 | A | 65 | C |
| Example 9 | 0.17 | C | 0.1 | A | 63 | C |
| Example 10 | 0.16 | C | 0.1 | A | 62 | C |
| Example 11 | 0.15 | C | 0.1 | A | 61 | C |
| Example 12 | 0.16 | C | 0.1 | A | 60 | C |
| Example 13 | 0.17 | C | 0.1 | A | 61 | C |
| Example 14 | 0.18 | C | 0.1 | A | 62 | C |
| Example 15 | 0.18 | C | 0.1 | A | 60 | C |
| Example 16 | 0.18 | C | 0.1 | A | 61 | C |
| Example 17 | 0.19 | C | 0.2 | B | 62 | C |
| Example 18 | 0.18 | C | 0.4 | B | 60 | C |
| Example 19 | 0.18 | C | 0.8 | C | 62 | C |
| Example 20 | 0.18 | C | 0.8 | C | 60 | C |
| Example 21 | 0.19 | C | 0.8 | C | 61 | C |
| Example 22 | 0.20 | C | 0.8 | C | 61 | C |
| Example 23 | 0.21 | C | 0.8 | C | 61 | C |
| Example 24 | 0.22 | C | 0.8 | C | 60 | C |
| Example 25 | 0.22 | C | 0.9 | C | 62 | C |
| Example 26 | 0.23 | C | 0.9 | C | 61 | C |
| Example 27 | 0.23 | C | 0.9 | C | 60 | C |
| Example 28 | 0.24 | C | 0.9 | C | 61 | C |
| Comparative Example 1 | 0.26 | D | 1.2 | D | 54 | D |
| Comparative Example 2 | 0.28 | D | 1.3 | D | 51 | D |

TABLE 5-2-continued

| Example | Transfer efficiency: Density difference | Transfer efficiency: Evaluation | Hot offset resistance: Fogging (%) | Hot offset resistance: Evaluation | Charging performance: Retention rate (%) | Charging performance: Evaluation |
|---|---|---|---|---|---|---|
| Comparative Example 3 | 0.31 | D | 1.5 | D | 47 | D |

In Example 1, excellent results were obtained in terms of durability, low-temperature fixability, storability, transfer efficiency, hot offset resistance and charging performance.

Excellent results were also obtained in Example 2, although the charging performance was somewhat inferior to that of Example 1 because the content of units derived from styrene in the wax dispersant was lower.

Excellent results were also obtained in Example 3, although the charging performance was somewhat inferior to that of Examples 1 and 2 because the content of units derived from styrene in the wax dispersant was even lower.

In Example 4, the content of units derived from styrene in the wax dispersant was greater, but the polyolefin content of the dispersant was lower. As a result, in comparison with Examples 1, 2, and 3, dispersion of the wax and the wax dispersant in the toner was less, and charging performance was somewhat inferior but excellent results were still obtained.

In Example 5, the content of units derived from styrene in the wax dispersant was even greater, but because the polyolefin content of the dispersant was lower, dispersion of the wax and the wax dispersant in the toner was somewhat less, and charging performance was somewhat inferior but good results were still obtained.

In Example 6, good results were obtained even though the charging performance was reduced due to the reduced content of units derived from styrene in the wax dispersant.

In Example 7, wax leaching was not suppressed in high-temperature, high humidity environments because the wax dispersant did not contain a saturated alicyclic compound, so the charging performance was reduced but the results were still at an acceptable level in the present invention.

In Example 8, good results were obtained but the transfer efficiency was somewhat inferior in comparison with Example 7 because the average circularity of the toner was 0.960.

In Example 9, the transfer efficiency was inferior in comparison with Examples 7 and 8 because the average circularity of the toner was 0.955, but the results were still at an acceptable level in the present invention.

In Example 10, because the aliphatic compound condensed on the end of the crystalline polyester resin was stearyl alcohol, storability was somewhat inferior to that obtained with stearic acid in Example 9, but the results were still excellent.

In Example 11, because the aliphatic compound condensed on the end of the crystalline polyester resin was arachidic acid (carbon number C20), low-temperature storability was somewhat inferior to that obtained with carbon number C18 in Examples 9 and 10, but the results were still excellent.

In Example 12, because the aliphatic compound condensed on the end of the crystalline polyester resin was capric acid (carbon number C10), storability was somewhat inferior, but the results were still excellent.

In Example 13, because the aliphatic compound condensed on the end of the crystalline polyester resin was heneicosylic acid (carbon number C21), low-temperature fixability was reduced but the results were still good.

In Example 14, because the aliphatic compound condensed on the end of the crystalline polyester resin was pelargonic acid (carbon number C9), storability was reduced but the results were still good.

In Example 15, storability was reduced because no aliphatic compound was condensed on the end of the crystalline polyester resin, but the results were still good.

In Example 16, low-temperature fixability was inferior to that obtained in Example 15 because the added amount of the crystalline polyester was reduced to 10.0 mass parts, but the results were still good.

In Example 17, low-temperature fixability was somewhat inferior because the added amount of the crystalline polyester was reduced to 5.0 mass parts, but the results were still excellent. Because the added amounts of the wax and crystalline polyester were the same, moreover, somewhat more wax was leached during heat treatment, so durability was somewhat inferior to that of Examples 15 and 16, but the results were still excellent.

In Example 18, storability was reduced because the added amount of the crystalline polyester was increased to 16.0 mass parts, but the results were at an acceptable level in the present invention.

In Example 19, low-temperature fixability was reduced because the added amount of the crystalline polyester was reduced to 0.9 mass parts, but the results were still at an acceptable level in the present invention. Because the added amount of the wax was greater than the added amount of the crystalline polyester, moreover, durability was reduced, but was still at a good level.

In Example 20, low-temperature fixability was reduced because the weight-average molecular weights of the crystalline polyester resin and amorphous vinyl segments were increased, but the results were still at an acceptable level in the present invention.

In Example 21, storability was reduced because the weight-average molecular weights of the crystalline polyester resin and amorphous vinyl segments were reduced, but the results were still at an acceptable level in the present invention.

In Example 22, low-temperature fixability was reduced in comparison with Example 20 because the weight-average molecular weights of the crystalline polyester resin and amorphous vinyl segments were further increased, but the results were still at an acceptable level in the present invention.

In Example 23, the acid component and alcohol component of the crystalline polyester resin were changed to adipic acid (C6) and 1,12-dodecanediol (C12), respectively, but there was no significant difference in comparison with the combination of dodecanedioic acid (C12) and 1,6-hexanediol (C6) in Example 21.

In Examples 24, 25 and 26, the acid component and alcohol component of the crystalline polyester resin were sebacic acid (C10) and 1,10-decanediol (C10), sebacic acid (C10) and 1,6-hexanediol (C6), and fumaric acid (C4) and 1,6-hexanediol (C6), respectively. Although storability was reduced as a result in comparison with Examples 21 and 22, the results were still at an acceptable level in the present invention.

In Examples 27 and 28 and Comparative Example 1, the mass ratio of the crystalline polyester segments and amorphous vinyl segments in the crystalline polyester resin (crystalline segments/amorphous segments) was 70/30, 98/2 and 65/45, respectively. When the mass ratio of the crystalline polyester segments was a low ratio of 65, durability declined and resulted at an unacceptable level in the present invention.

In Comparative Example 2, no heat treatment was performed and transfer efficiency was not improved.

In Comparative Example 3, durability was much less because the crystalline polyester was not a hybrid resin.

While the present invention has been described with reference to exemplary embodiments, it is to be understood that the present invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-052608, filed Mar. 16, 2016, which is hereby incorporated by reference herein in its entirety.

What is claimed is:

1. A toner obtained by heat treating a toner particle containing a crystalline polyester resin, an amorphous polyester resin, a hydrocarbon wax and a wax dispersant, the crystalline polyester resin being a hybrid resin having crystalline polyester segments and amorphous vinyl segments, the wax dispersant being a graft-polymer containing a polyolefin onto which a styrene acrylic polymer is grafted, and the styrene acrylic polymer containing a monomer unit represented by Formula (1)

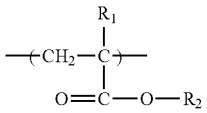

(1)

where $R_1$ represents a hydrogen atom or methyl group, and $R_2$ represents a saturated alicyclic group, wherein a mass ratio of the crystalline polyester segments and the amorphous vinyl segments in the crystalline polyester resin (crystalline segments/amorphous segments) is 70/30 to 98/2.

2. The toner according to claim 1, wherein the crystalline polyester segments are a polycondensate of a $C_{6-12}$ aliphatic diol and a $C_{6-12}$ aliphatic dicarboxylic acid.

3. The toner according to claim 1, wherein a weight-average molecular weight of the crystalline polyester resin is 5,000 to 50,000, and a weight-average molecular weight of the amorphous vinyl segments is 5,000 to 50,000.

4. The toner according to claim 1, wherein the amorphous vinyl segments are a copolymer of a vinyl polymerizable monomer and acrylic acid.

5. The toner according to claim 1, wherein the content of the crystalline polyester resin is equal to or greater than the content of the hydrocarbon wax.

6. The toner according to claim 1, wherein the content of the crystalline polyester resin is 1.0 to 15.0 mass parts per 100.0 mass parts of the amorphous polyester resin.

7. The toner according to claim 1, wherein one or more aliphatic compounds selected from the group consisting of $C_{10-20}$ aliphatic monocarboxylic acids and $C_{10-20}$ aliphatic monoalcohols is condensed at the end of a molecular chain of the crystalline polyester resin.

8. The toner according to claim 1, which has an average circularity of 0.960 to 1.000.

9. The toner according to claim 1 wherein the content of the units derived from styrene in the wax dispersant is 20 to 90 mass %.

10. A method for manufacturing a toner including a toner particle containing a crystalline polyester resin, an amorphous polyester resin, a hydrocarbon wax and a wax dispersant, the crystalline polyester resin being a hybrid resin having crystalline polyester segments and amorphous vinyl segments, the wax dispersant being a graft-polymer containing a polyolefin onto which a styrene acrylic polymer is grafted, and the styrene acrylic polymer containing a monomer unit represented by Formula (1)

(1)

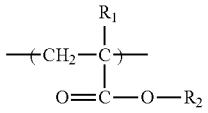

where $R_1$ represents a hydrogen atom or methyl group, and $R_2$ represents a saturated alicyclic group, wherein a mass ratio of the crystalline polyester segments and the amorphous vinyl segments in the crystalline polyester resin (crystalline segments/amorphous segments) is 70/30 to 98/2, the method comprising a step of heat treating the toner particle.

11. The method according to claim 10, wherein the crystalline polyester segments are a polycondensate of a $C_{6-12}$ aliphatic diol and a $C_{6-12}$ aliphatic dicarboxylic acid.

12. The method according to claim 10, wherein the amorphous vinyl segments are a copolymer of a vinyl polymerizable monomer and acrylic acid.

13. The method according to claim 10, wherein the content of the crystalline polyester resin is equal to or greater than the content of the hydrocarbon wax.

14. The method according to claim 10, wherein the content of the crystalline polyester resin is 1.0 to 15.0 mass parts per 100.0 mass parts of the amorphous polyester resin.

15. The method according to claim 10, wherein the crystalline polyester resin is a resin having one or more aliphatic compounds selected from the group consisting of $C_{10-20}$ aliphatic monocarboxylic acids and $C_{10-20}$ aliphatic monoalcohols condensed at the end of a molecular chain.

16. The method according to claim 10, wherein the content of the units derived from styrene in the wax dispersant is 20 to 90 mass %.

17. The toner according to claim 1, wherein $R_2$ represents a $C_{3-18}$ saturated alicyclic hydrocarbon group.

18. The toner according to claim 1, wherein $R_2$ represents a $C_{4-10}$ cycloalkyl group.

19. The method according to claim 10, wherein $R_2$ represents a $C_{3-18}$ saturated alicyclic hydrocarbon group.

20. The method according to claim 10, wherein $R_2$ represents a $C_{4-10}$ cycloalkyl group.

* * * * *